US011484125B2

(12) United States Patent
Samila

(10) Patent No.: US 11,484,125 B2
(45) Date of Patent: Nov. 1, 2022

(54) MULTI-AXIS HEADREST SYSTEM AND METHOD

(71) Applicant: Motion Concepts L.P., Concord (CA)

(72) Inventor: Ivan Daniel Samila, Stoufville (CA)

(73) Assignee: INVACARE CORPORATION, Elyria, OH (US)

( * ) Notice: Subject to any disclaimer, the term of this patent is extended or adjusted under 35 U.S.C. 154(b) by 0 days.

(21) Appl. No.: 17/216,298

(22) Filed: Mar. 29, 2021

(65) Prior Publication Data

US 2022/0304471 A1 Sep. 29, 2022

(51) Int. Cl.
*A47C 7/36* (2006.01)
*A47C 7/38* (2006.01)

(52) U.S. Cl.
CPC ..... *A47C 7/38* (2013.01)

(58) Field of Classification Search
CPC .. A61G 5/121; A61G 5/12; A47C 7/38; A47C 1/10; B60N 2/806
See application file for complete search history.

(56) References Cited

U.S. PATENT DOCUMENTS 3,188,079 A * 6/1965 Boetcker ..... A61G 13/12 5/622
3,730,589 A * 5/1973 Lane ..... A61G 5/121 297/391
4,732,423 A * 3/1988 Condon ..... A61G 5/00 297/284.1
5,332,287 A * 7/1994 Whitmyer ..... A47C 7/38 297/405
5,791,735 A * 8/1998 Helman ..... A61G 5/121 297/404
5,967,613 A * 10/1999 McKeever ..... A61G 5/121 297/397
6,419,321 B1 * 7/2002 Sack ..... A61G 5/12 297/405

(Continued)

OTHER PUBLICATIONS https://www.waltonmedical.com/products/first-class-school-chair-multi-axis-headrest?variant=339781844608&currency=CAD&utm, Copyright 2016 (accessed Jul. 30, 2021).

(Continued)

*Primary Examiner* — Shin H Kim
(74) *Attorney, Agent, or Firm* — Calfee, Halter & Griswold LLP

(57) ABSTRACT

A multi-axis headrest system for simultaneously locking or adjusting all axis of an adjustable headrest with a single lever or a single point of adjustment is provided. No external tools are required but may be used if desired. The single lever or point of adjustment allows the headrest to be correctly positioned optimizing the comfort, function and safety of the user. The single lever or point of adjustment provides the caregiver, or attending individual, the ability to adjust the positioning of the headrest with greater ease, more control and confidence. The single lever or point of adjustment causes a locking mechanism or means to generate a clamping force that locks the headrest in place. The same lever or point of adjustment also causes the locking mechanism or means to release the clamping force to allow adjustment of the headrest. The ease of adjustability is achieved without compromising security and durability.

18 Claims, 19 Drawing Sheets

(56) References Cited

U.S. PATENT DOCUMENTS

| | | | | |
|---|---|---|---|---|
| 6,761,338 | B2 * | 7/2004 | Yamasaki | A61G 5/1067 248/118 |
| 7,104,610 | B2 * | 9/2006 | Cramer | A61G 5/12 248/230.1 |
| 7,571,502 | B2 * | 8/2009 | Frano | A61G 5/12 297/391 |
| 7,993,069 | B2 | 8/2011 | Persson | |
| 8,911,019 | B2 * | 12/2014 | Josten | G05G 1/01 297/405 |
| 9,352,675 | B2 * | 5/2016 | Walker | B60N 2/865 |
| 10,327,554 | B2 * | 6/2019 | DuFresne | A47C 7/38 |
| 10,716,721 | B2 * | 7/2020 | Culver | E05D 5/128 |
| 2003/0178880 | A1 * | 9/2003 | Hannah | A61G 5/121 297/406 |
| 2009/0065671 | A1 | 3/2009 | Burgstaller | |
| 2010/0172643 | A1 | 7/2010 | Sudhana et al. | |
| 2010/0201165 | A1 * | 8/2010 | Dankovich | A47C 7/72 297/135 |
| 2012/0080921 | A1 * | 4/2012 | Vicente | A61B 90/60 297/391 |
| 2012/0261965 | A1 * | 10/2012 | Elizalde | A47C 7/383 297/391 |
| 2013/0069411 | A1 * | 3/2013 | Walker | A47C 7/38 297/391 |
| 2016/0101716 | A1 * | 4/2016 | Brecht | B61D 33/005 297/397 |

OTHER PUBLICATIONS https://www.amazon.com/Karman-Universal-Folding-Headrest-Wheelchair/dp/B00B22MAQW/ref=sr_1_5?dchild=1&keywords=karman+healthcare+universal+folding+headrest+for+wheelchair&qid=1627650181&rdc=1&sr=8-5 (accessed Jul. 30, 2021).
https://stealthproducts.com/506/ (accessed Jul. 30, 2021).
http://permobil.ca/products/power-wheelchairs-by-permobil/accessories/headrests/, Copyright 2021 (accessed Jul. 30, 2021).
https://media.ottobock.com/mobility/_general/files/seating-and-positioning-poduct-information.pdf, Copyright 2012 (accessed Jul. 30, 2021).
https://www.futuremobility.ca/headrest-aries-steady, Copyright 2021 (accessed Jul. 30, 2021).
https://www.futuremobility.ca/order-form/#accessories, Copyright 2021 (accessed Jul. 30, 2021).
https://www.mapleleafwheelchair.ca/products/seating/headrests/product/ml-contour, Copyright 2021 (accessed Jul. 30, 2021).
http://daherproducts.com/product/wheelchair-headrest/, Copyright 2017 (accessed Jul. 30, 2021).
https://www.dmg-lib.org/dmglib/main/portal.jsp?mainNaviState=browsen.images.viewer&id=15975023 (accessed Jul. 30, 2021).
https://www.reddit.com/r/askengineers/comments/458vso/ball_joints_how_does_one_lock_the_position_of_the/ (accessed May 5, 2021).
https://www.manualslib.com/manual/1305002/Pdermobil-M5-Corpus.html?page=88#manual (accessed Jul. 30, 2021).
https://permobil.ca/product/corpus-3g-headrest/.
https://www.drivedevilbiss-int.com/products/mobility/wheelchair-accessories/26/headrest, copyright 2021.

* cited by examiner

MULTI-AXIS HEADREST SYSTEM AND METHOD

BACKGROUND

Seating and positioning systems provide important function, safety and comfort for users and patients. One component a seating and positioning system is a headrest. A headrest is typically mounted above a seat back (or in some cases is part of the seat back) and allows a user to rest their head there against. Adjustable headrest systems have been developed for positioning the headrest to accommodate the varied size, posture and body of users.

However, adjustability has been problematic because most secure solutions tend to require tools to loosen the headrest system so it can be adjusted and to tighten it for locking or strongly securing it from further movement after adjustment. This can be disadvantageous because it can be time consuming and proper tools are needed each time an adjustment or re-adjustment needs to be made. Tool-less adjustability has been attempted but has not been entirely successful. While allowing for quick and tool-less adjustment, these headrest systems tended to not provide as strong of a lock or securement as provided by the systems requiring tools. Hence, a compromise has existed between tooled and tool-less systems with regard to how securely can the headrest system be lock against further movement.

What is desired is a tool-less, multi-axis, adjustable head rest system that addresses these and other shortcomings.

SUMMARY

In one embodiment, a headrest system and method is provided for adjusting the position of a headrest relative to a user or patient for function, comfort and safety. The system includes a headrest mounting assembly to mount the head rest to, for example, a seating system of a wheelchair or seat, a headrest extension tube for mounting a headrest cushion or pad, housing receiving at least a portion of the headrest mounting assembly and extension tube therein, a lever connected to the housing, and a locking mechanism responsive to movement of the lever for locking and unlocking the adjustability of the headrest system. Movement of the lever in a first direction creates an increasing clamping force between the locking mechanism and the headrest mounting assembly and headrest extension tube thereby resisting movement of these components. Movement of the lever in a second direction creates a decreasing clamping force between the locking mechanism and the headrest mounting assembly and headrest extension tube thereby allowing movement of these components. In this manner, the headrest assembly can be adjusted in any one or more of four dimensions including yaw, roll, pitch, and extension for patient or user function, comfort and safety.

In another embodiment, the headrest system has a single lever or single point for adjustment and does not require external tools to lock and unlock the adjustability of the headrest system.

In another embodiment, the locking mechanism comprises at least one movable wedge for clamping and unclamping a portion of the headrest mounting assembly and headrest extension tube against the housing.

In another embodiment, the locking mechanism comprises at least one movable cam component for clamping and unclamping a portion of the headrest mounting assembly and headrest extension tube against the housing.

BRIEF DESCRIPTION OF THE DRAWINGS

In the accompanying drawings which are incorporated in and constitute a part of the specification, embodiments of the invention are illustrated, which, together with a general description of the inventions above, and the detailed descriptions given below, serve to example the principles of the inventions.

DESCRIPTION

Embodiments of the inventions provide, for example, a headrest system and method for simultaneously locking or adjusting all axis of an adjustable headrest with a single lever or a single point of adjustment. No external tools are required but may be used if desired. The single lever or point of adjustment allows the headrest to be correctly positioned to optimize the comfort, function and safety of the user. The single lever or point of adjustment provides the caregiver, or attending individual, the ability to adjust the positioning of the headrest with greater ease, more control and confidence. The single lever or point of adjustment causes a locking mechanism or means to generate a clamping force that locks the headrest in place. The same lever or point of adjustment also causes the locking mechanism or means to release the clamping force to allow adjustment of the headrest. The ease of adjustability is achieved without compromising security and durability. As will be described in more detail, the locking mechanism or means can take the form of several embodiments.

Figure 1:
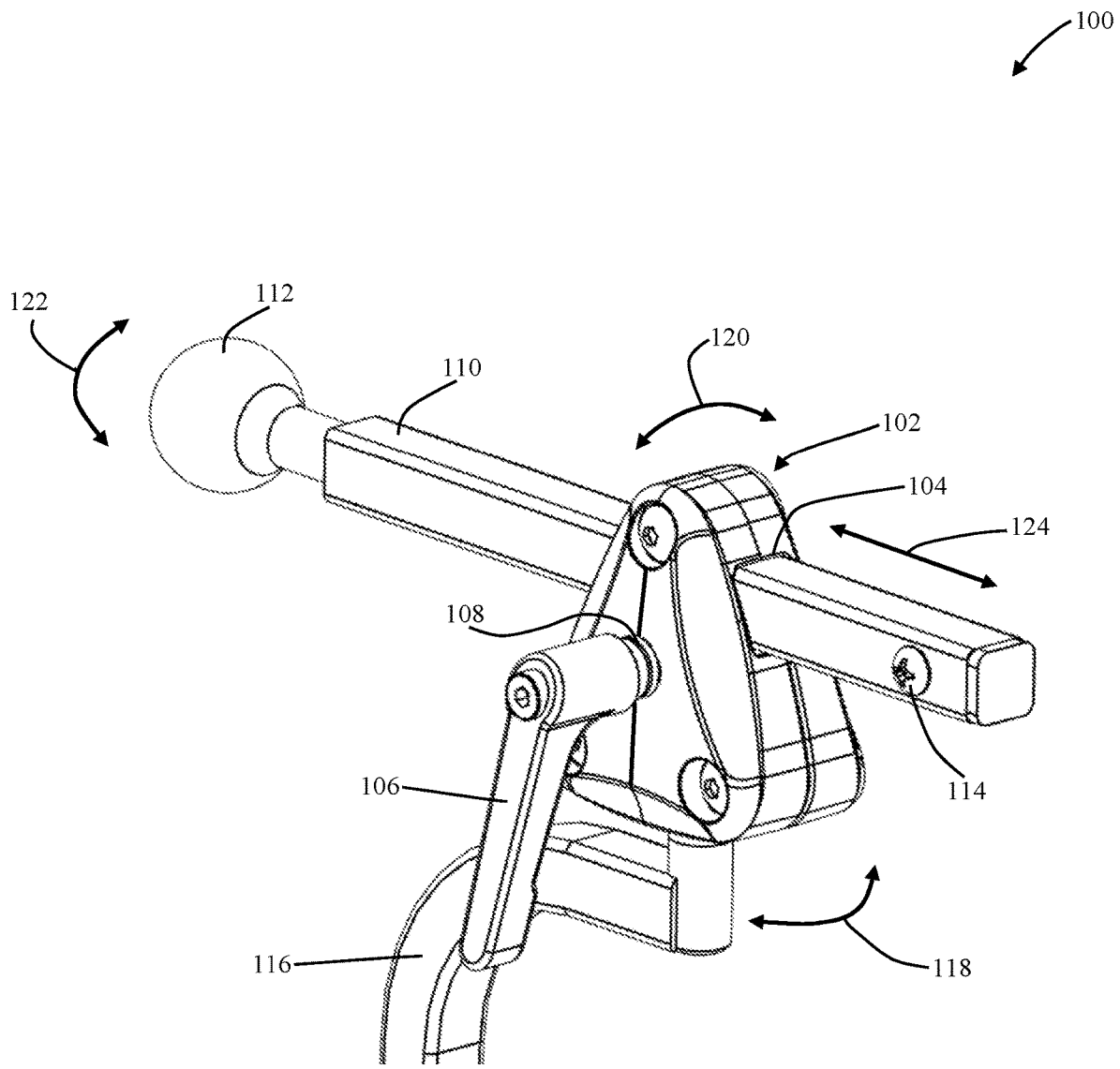
FIG. 1 illustrates an embodiment of a multi-axis adjustable headrest system and method.

FIG. 1 illustrates an embodiment 100 of a multi-axis adjustable headrest system and method. The system includes a housing 102 having an opening 104 in which a headrest extension tube 110 resides and can be moved. The headrest extension tube or rod 110 as a headrest pad attachment ball 112 at one end. A headrest pad (e.g., 802 in FIG. 8) can be attached to ball 112 for the comfort of the user. A screw head or other projection 114 is provided on the other end of extension tube 110 to limit movement of the extension tube 110. The movement is limited when screw head or projection 114 comes into contact with housing 102. A handle or lever 106 is also provided for rotating clockwise and counterclockwise to cause a locking mechanism inside the housing 102 to lock or unlock the headrest system from adjustability. An opening 108 and housing 102 is provided that connects handle 106 to the locking mechanism. A mounting assembly 116 is provided to mount the headrest system to the backside of a seat back (e.g., 812 of FIG. 8)

The headrest system is adjustable in four dimensions or directions. This includes yaw angle 118, roll angle 120, pitch angle 122, and extension/retraction 124. By using a single handle 106 (or single point of adjustment), the locking mechanism or means inside housing 102 locks and unlocks the headrest system from adjustment in all four of these dimensions or directions through a clamping force (though other types of forces can also be used). Generally, the locking mechanism or means includes a first surface portion for contacting the extension tube and a second surface portion for contacting the mounting assembly. Movement of the handle or lever 106 causes the locking mechanism or means to move these surfaces into and out of engagement with the extension tube and mounting assembly to clamp and unclamp these components from movement. Hence, a caregiver or attending individual has the ability to adjust the positioning of the headrest with greater ease, more control and confidence through a single point of adjustment. No additional tools are necessary nor are multiple or separate points of adjustment required to lock and unlock each of the dimensions or directions of the headrest system. The single lever or point of adjustment allows the headrest to be correctly positioned to optimize the comfort, function and safety of the user in less time and without the need to carry or use tools. As will be described in more detail hereinafter, the locking mechanism or means can take the form of several embodiments that lock or unlock through the use of a single lever or single point of adjustment.

FIGS. 2A-2M illustrates another embodiment 200 of a multi-axis adjustable headrest system and method having wedge-type locking mechanism or means. FIGS. 2A, 2C-2F show various perspective views of the headrest system. Referring to FIG. 2B, which shows an exploded perspective view of the head rest assembly, the locking mechanism or means includes first and second wedge components 202 and 204 each wedge component includes an opening 220 and 222 for receiving shaft 216 of handle or lever 106. Opening 222 is threaded so as to receive a threaded portion of shaft 216 of handle or lever 106. A washer 218 is also provided. Housing 102 includes first and second housing portions 206 and 208, which are held together via fasteners 224 (e.g., screws or bolts) and contain holes or passageways (which can be threaded) therefore. A channel/passageway 210 is provided in each housing portion 206 and 208 for allowing the adjustability and retaining of extension tube 110. (See FIG. 2G showing extension tube 110 within channel/passageway 210). Each housing portion 206 and 208 also includes an opening 226 and a socket portion 212 for allowing the adjustability and retaining of mounting ball 214. (See FIGS. 2G and 2H showing mounting ball 214 within socket portion 212). Each housing portion 206 and 208 also includes retaining space 205 for retaining and allowing movement of wedge components 202 and 204. (See also FIGS. 2H and 2I showing, for example, wedge 204 within space 205).

Figure 2A:
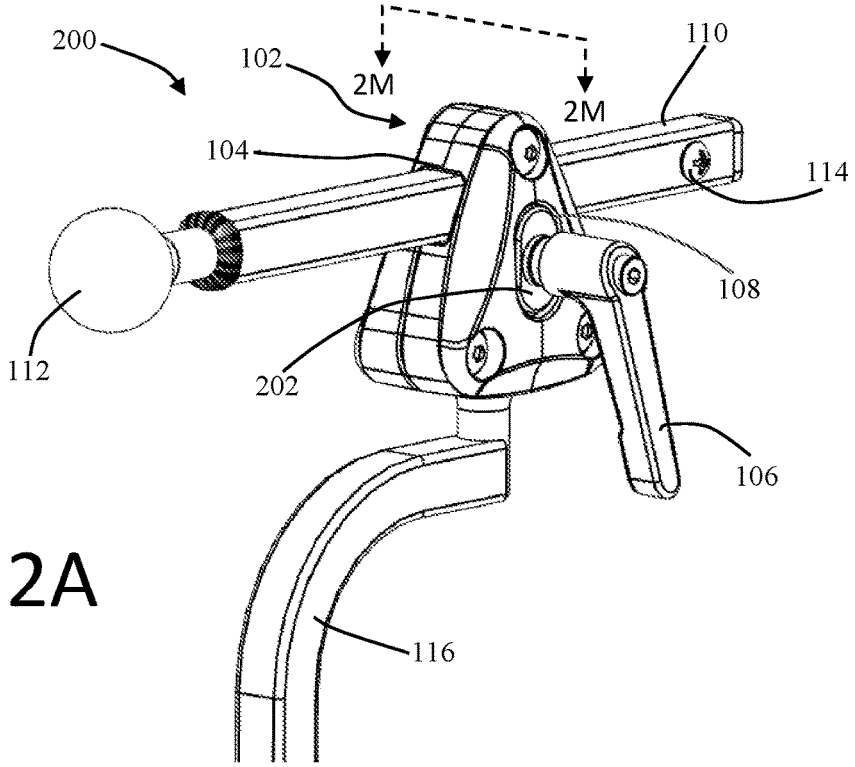
FIGS. 2A-2M illustrates another embodiment of a multi-axis adjustable headrest system and method having wedge-type locking mechanism or means.
Figure 2B:
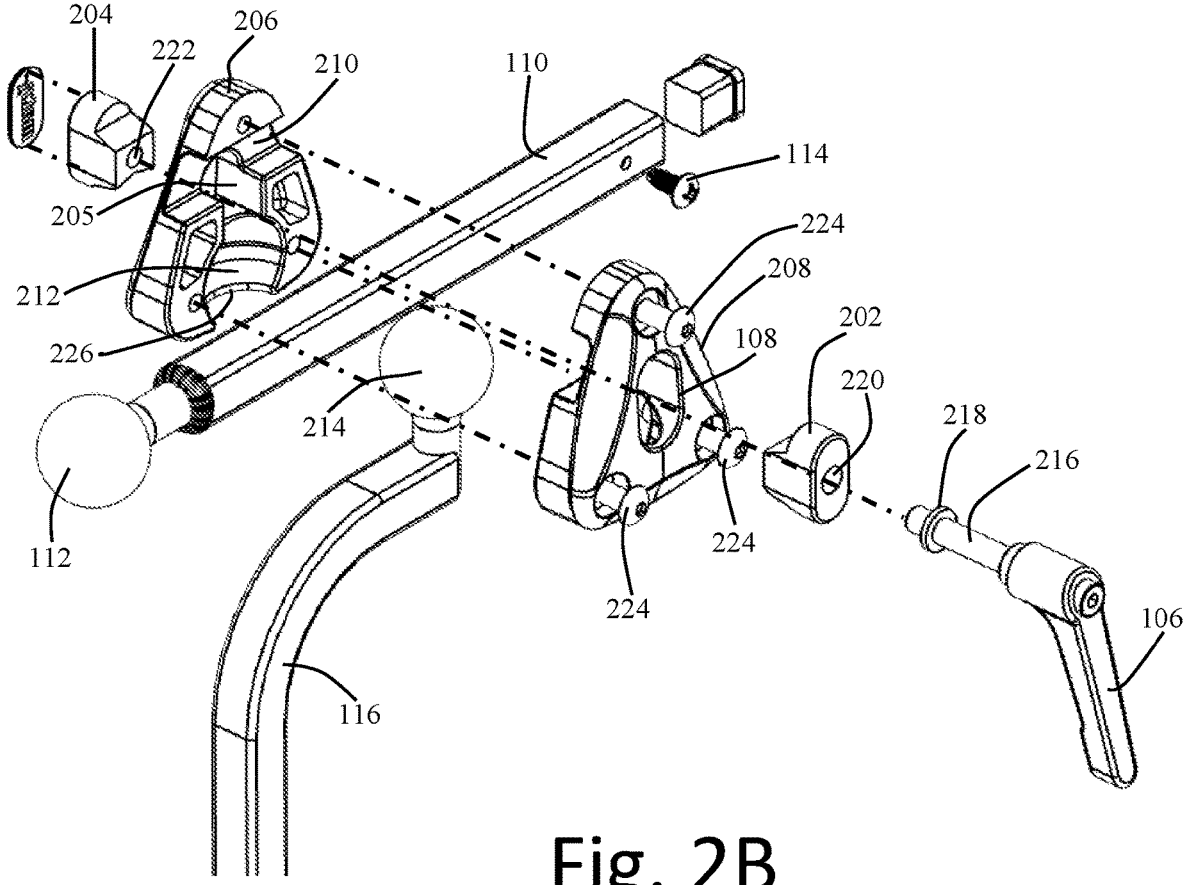
Figure 2C:
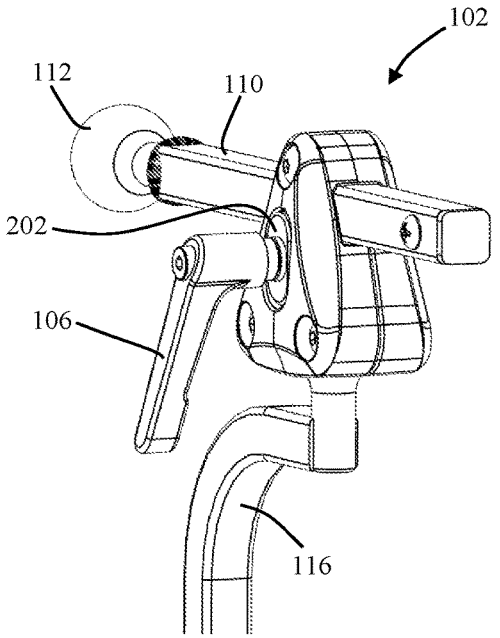
Figure 2D:
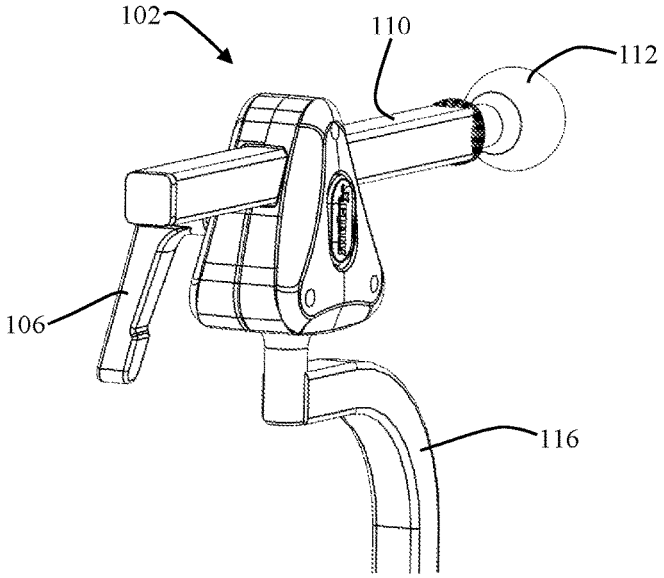
Figure 2E:
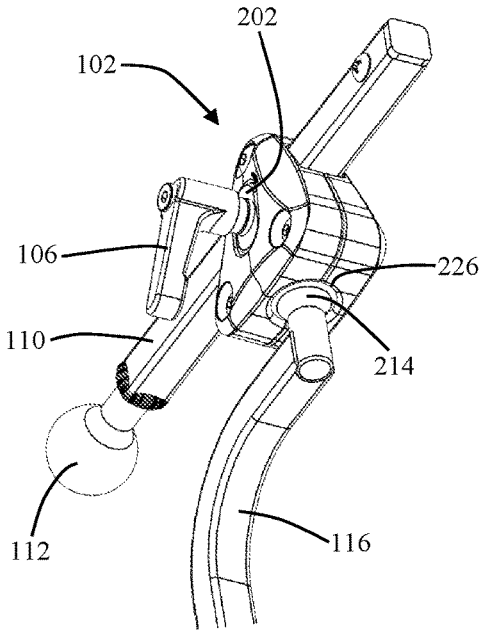
Figure 2F:
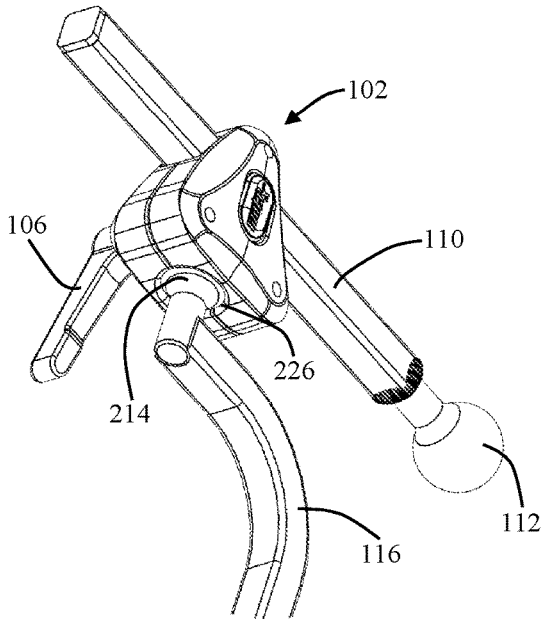
Figure 2G:
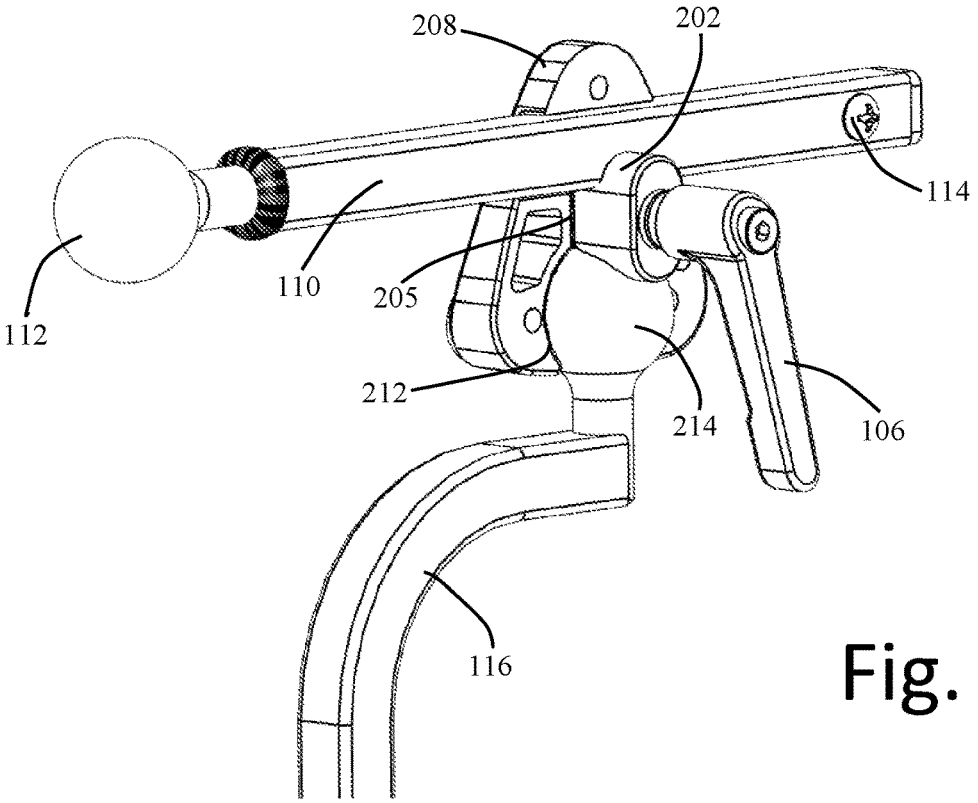
Figure 2H:
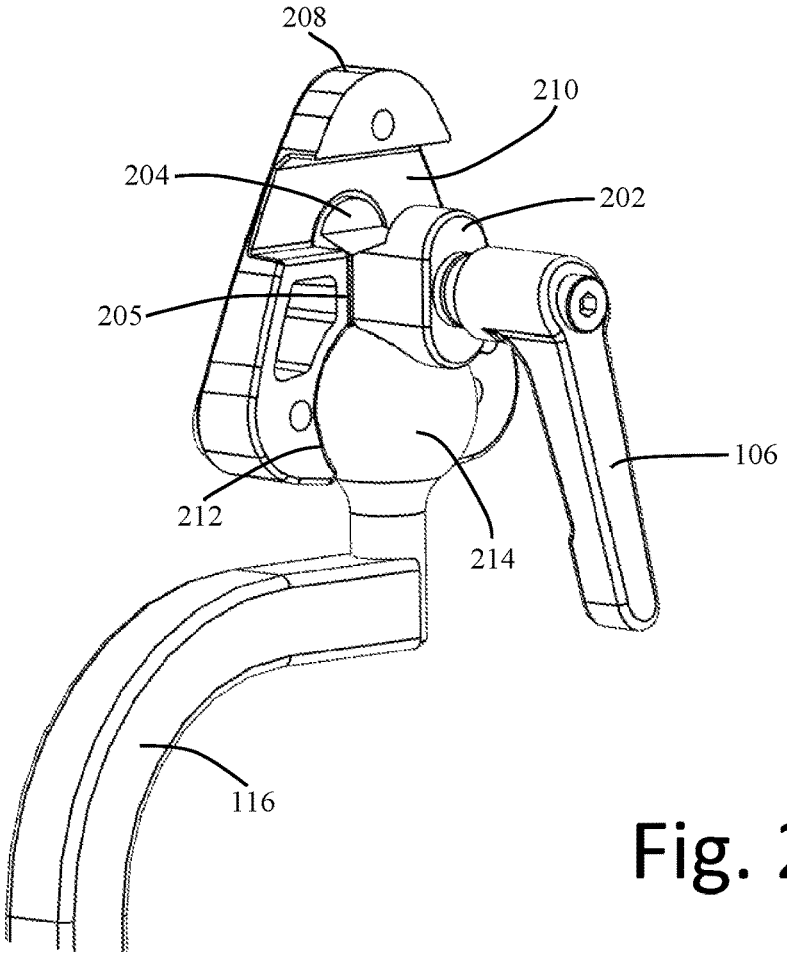
Figure 2I:
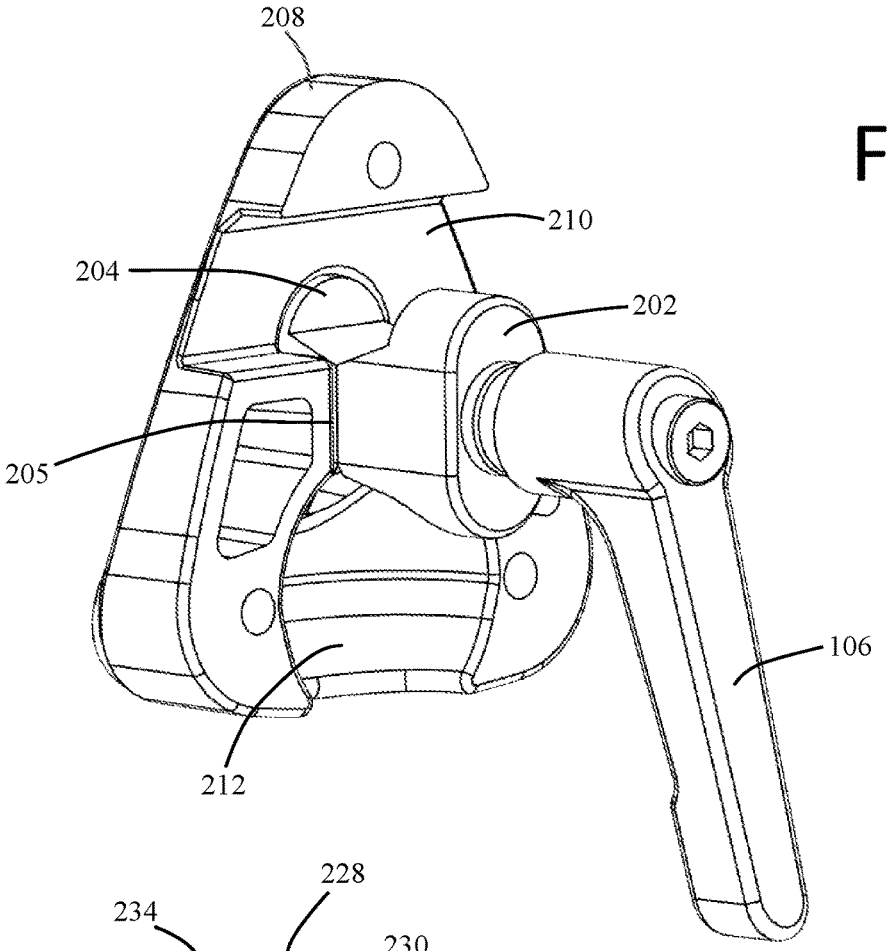
Figure 2J:
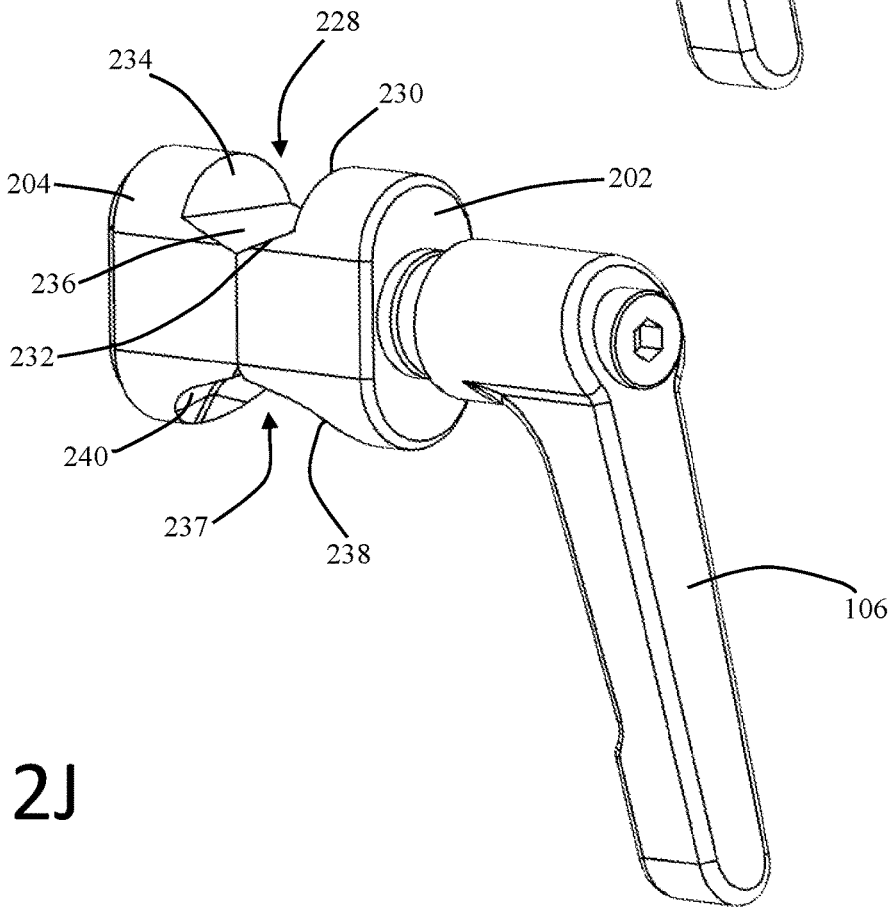
Figure 2K:
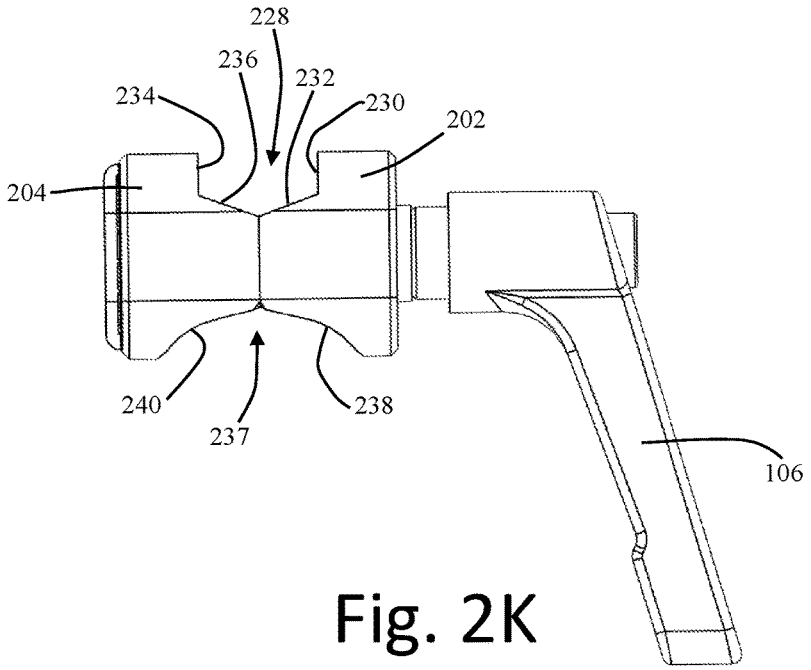
Figure 2L:
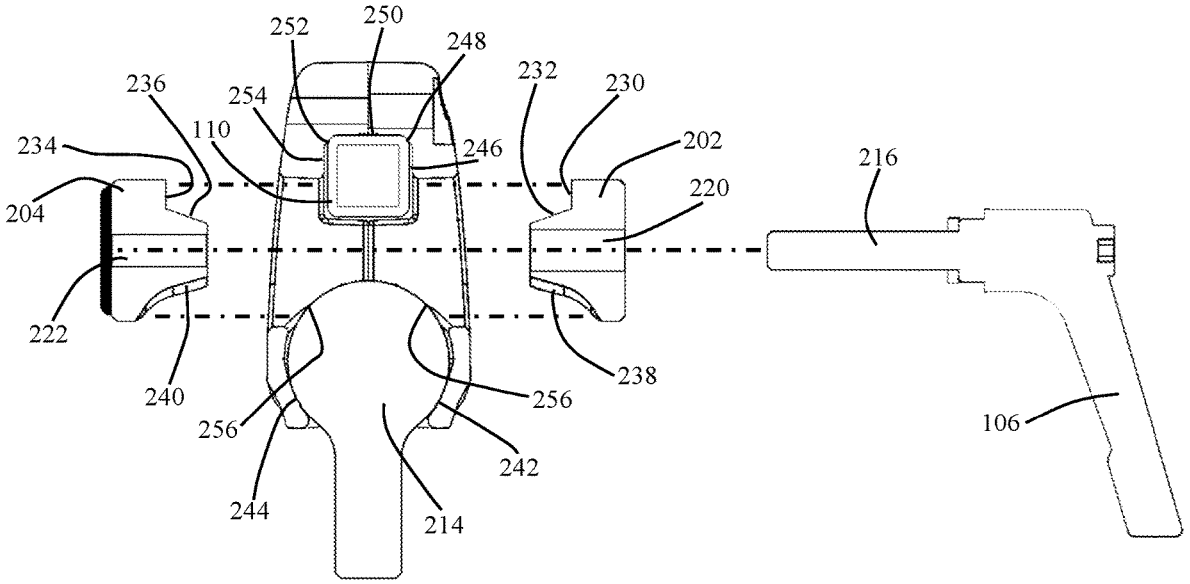
Figure 2M:
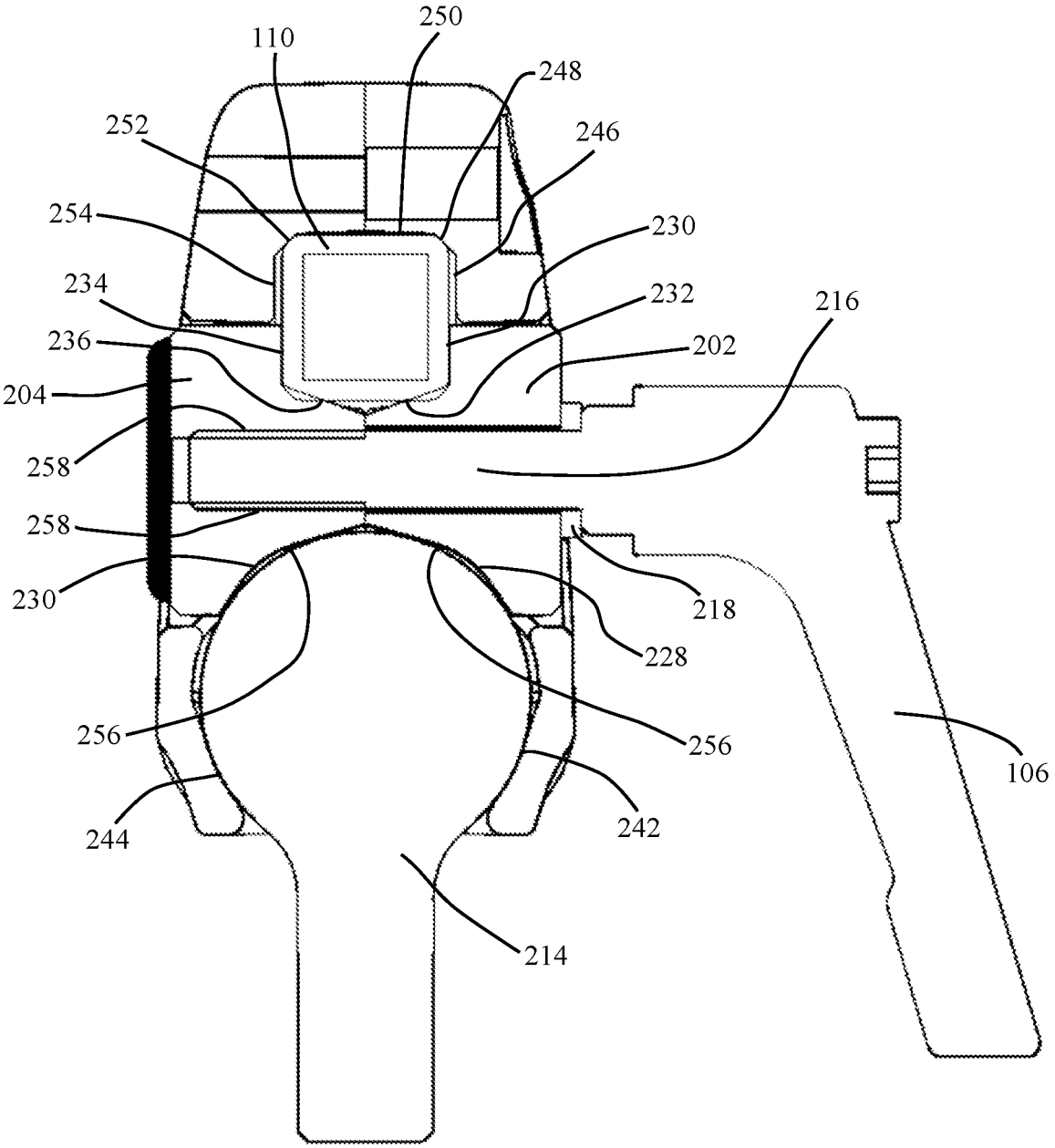

Referring now to FIGS. 2J-2K, a perspective view of the locking mechanism or means showing wedges 202 and 204 and handle/lever 106 is provided. The wedges form a space 228 for receiving a portion of extension tube 110. Wedge 202 includes a vertical wall 230 and a clamping or camming surface or wall 232. Wedge 204 similarly includes a vertical wall 234 and a clamping or camming surface or wall 236. In one embodiment, these walls are flat surfaces. In other embodiments, these walls can be curved surfaces such as convex, concave, and/or rounded. In yet other embodiments, these walls may have surface details that include undulation by a plurality of waves, peaks and/or valleys while still being generally flat or curved in larger dimension. In the present embodiment, vertical walls/surfaces 230 and 234 are substantially parallel to the corresponding vertical side walls of extension tube 110 (see also FIGS. 2K-2M showing the parallelism). In other embodiments, wall/surfaces 230 and 234 do not need to be substantially parallel and can be inclined or declined with respect to the vertical sidewalls of extension tube 110. Also, in the present embodiment, wedging or camming walls/surfaces 232 and 236 are shown as angled with respect to the bottom and side walls of extension tube 110 (see also FIGS. 2K-2M). More specifically, wedging or camming walls/surfaces 232 and 236 are angled so as to rise up to meet walls 230 and 234. This angled orientation allows wedges 202 and 204 to clamp (lock) and unclamp (unlock) extension tube 110 as the wedges come together and move apart by turning of handle/lever 106.

Wedges 202 and 204 also form a space 237 for receiving a portion of ball 214. Wedge 202 includes ball contact surface 238 and wedge 204 includes ball contact surface 240. These ball contact surfaces 238 and 240 allow wedges 202 and 204 to clamp (lock) and unclamp (unlock) ball 214. In one embodiment, these surfaces are at least partially curved to substantially match the curvature of ball 214. In other embodiments, these surfaces may be flatter (including flat) or less curved than the curvature of ball 214. In yet other embodiments, these surfaces may have surface details that include undulation by a plurality of waves, peaks and/or valleys while still being generally curved in larger dimension. (See also FIGS. 2K-2M showing curvature of surfaces 228, 240 and ball 214). The curvature of surfaces 238 and 240 allows wedges 202 and 204 to clamp (lock) and unclamp (unlock) against ball 214 as the wedges come together and move apart by turning of handle/lever 106.

FIG. 2M is a cross-sectional view taken along section lines 2M-2M of FIG. 2A showing the locking mechanism or means when it is locked and generating clamping forces on extension tube 110 and ball 214. In the present embodiment, wedges 202 and 204 generate clamping forces to securely hold extension tube 110 and ball 214. For extension tube 110, one portion of the clamping action/force is generated by angled wedge surfaces 232 and 236 as they come together through turning of handle/lever 106 and increasingly bear or press against the lower portion of extension tube 110 (which can include the lower corner portions, lower side wall portions, bottom wall portion, and other lower portions of extension tube 110). As the angled wedge surfaces 232 and 236 press against the lower portion of extension tube 110, this causes the upper portion of extension tube 110 to bear or press against one or more of housing channel/passageway 210 walls or surfaces 246, 248, 250, 252, and/or 254 thereby providing another portion of the clamping action/force. In one embodiment, extension tube 110 bears or presses against at least angled walls or surfaces 248 and 252. In other embodiments, where there are no angled walls or surfaces 248 and 252, extension tube 110 bears or presses against at least wall or surface 250. These walls or surfaces (e.g., 246-254) are substantially rigid and able to withstand significantly high (clamping) forces to allow secure holding/locking of extension tube 110 in position.

As previously described, wedges 202 and 204 also generate clamping forces to securely hold ball 214. One portion of the clamping action/force is generated by curved wedge surfaces 228 and 230 as they come together through turning of handle/lever 106 and increasingly bear or press against the upper and/or side portions 256 of ball 214. Upper/side portions 256 of ball 214 can include more or less than the upper and/or side portions illustrated. As curved wedge surfaces 228 and 230 bear or press against the top and/or sides 256, ball 214 is forced downwards to increasing bear or press against contact socket contact surfaces 242 and 244 (which may also be a single circumferential surface that is part of socket 212) thereby providing another portion of the clamping action/force against ball 214. Here too, these socket walls or surfaces (e.g., 242 and 244) are substantially rigid and able to withstand significantly high (clamping) forces to allow secure holding/locking of ball 214 in position. Hence, when handle/lever 106 is turned in a first direction (e.g., clockwise), wedges 202 and 204 generate a clamping action/force that locks both extension tube 110 and ball 214 against housing 102. Unclamping or unlocking is accomplished by rotating the handle/lever 106 in the opposite direction thereby moving wedges 202 and 204 apart and releasing the force or pressure bearing extension tube 110 and ball 214.

Figure 3A:
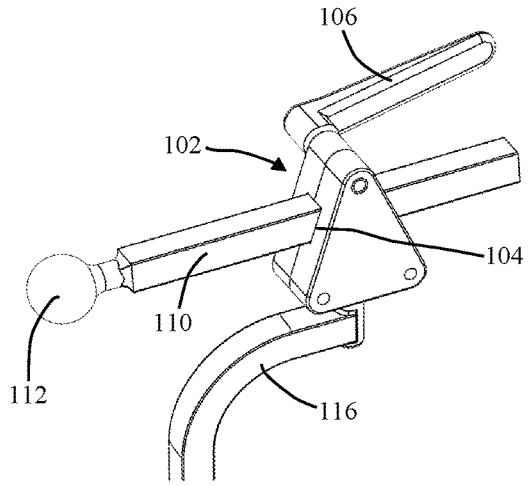
FIGS. 3A-3F illustrates another embodiment of a multi-axis adjustable headrest system and method having cam and shoe-type locking mechanism or means.
Figure 3B:
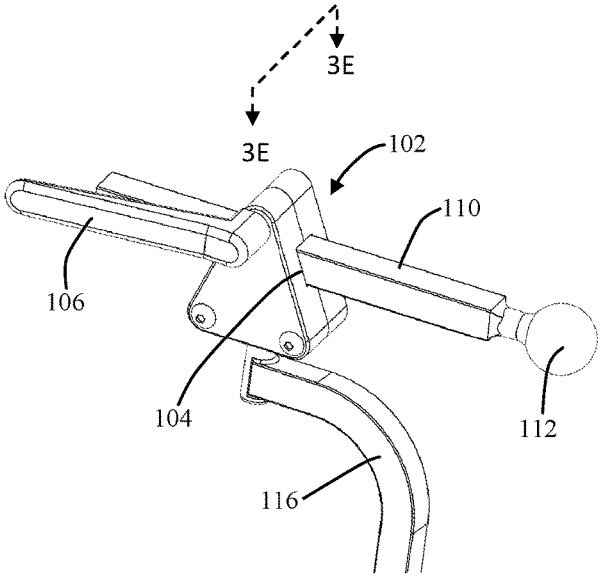
Figure 3C:
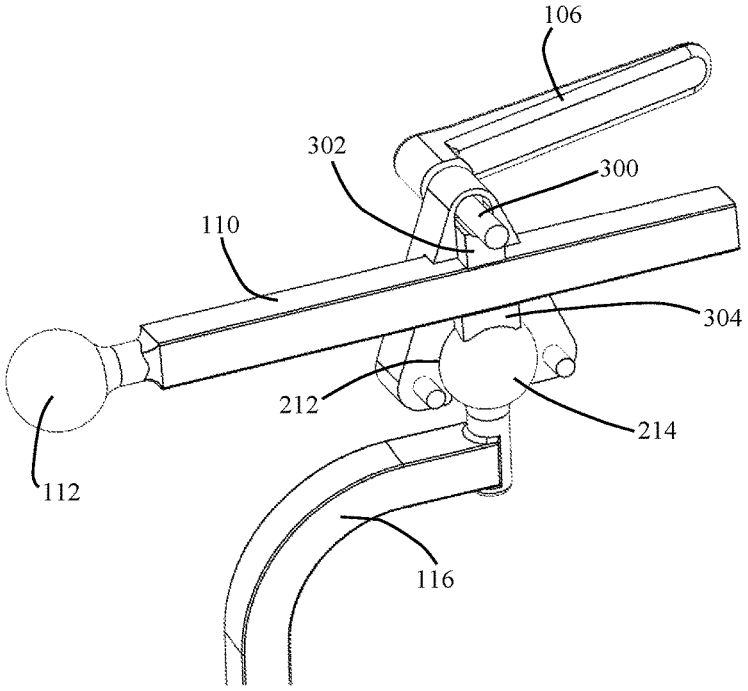

FIGS. 3A-3F illustrate another embodiment of a multi-axis adjustable headrest system and method. This embodiment includes a cam and shoe-type locking mechanism or means. FIGS. 3A-3B illustrate various perspective views of the adjustable headrest system. Referring now to FIG. 3C, where a portion of housing 102 has been removed, the locking mechanism or means includes a cam shaft 300 that is connected to handle/lever 106, a first or top shoe 302 and a second or ball shoe 304. Cam shaft 300 is positioned to contact shoe 302. Extension tube 110 is positioned between shoes 302 and 304. Ball 214 is positioned between shoe 304 and housing 102.

Figure 3D:
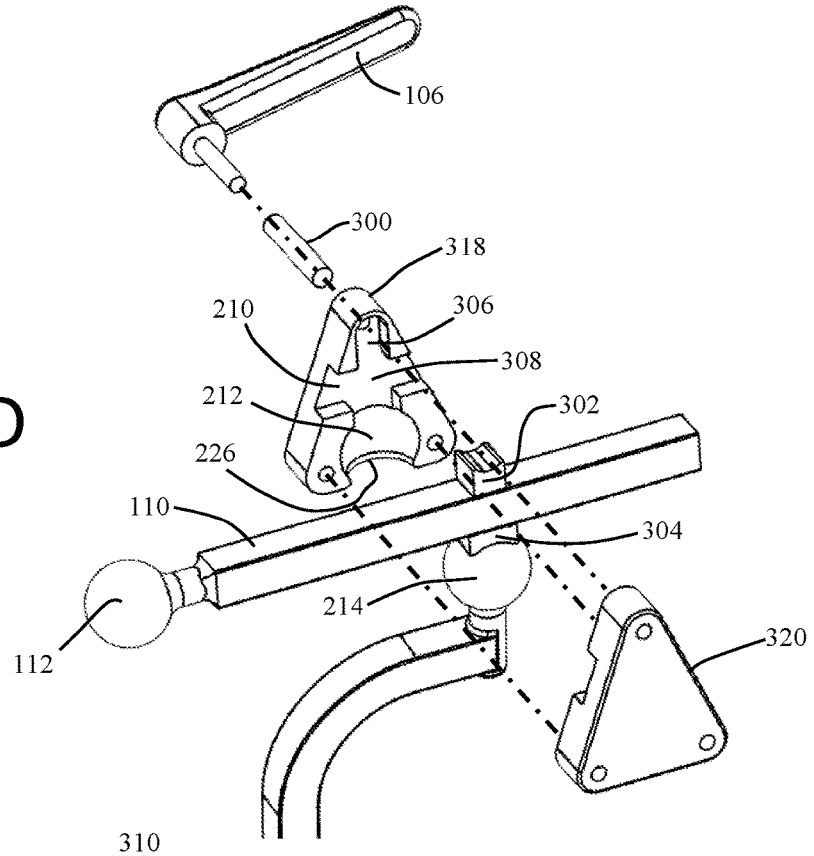

FIG. 3D illustrates an exploded perspective view of the multi-axis headrest system. Housing 102 includes first and second portions 318 and 320, which are fastened together similar to housing portions 206 and 208 of FIGS. 2A-2M. A first retaining channel/passage 306 is provided in the housing for cam shaft 300 and shoe 302. A second retaining channel/passage 308 is provided in the housing for shoe 304. These retaining channels/passages 306 and 308 allow movement of shoes 302 and 304 in one direction (e.g., vertical) while restricting or not allowing movement in other directions (e.g., horizontal).

Figure 3E:
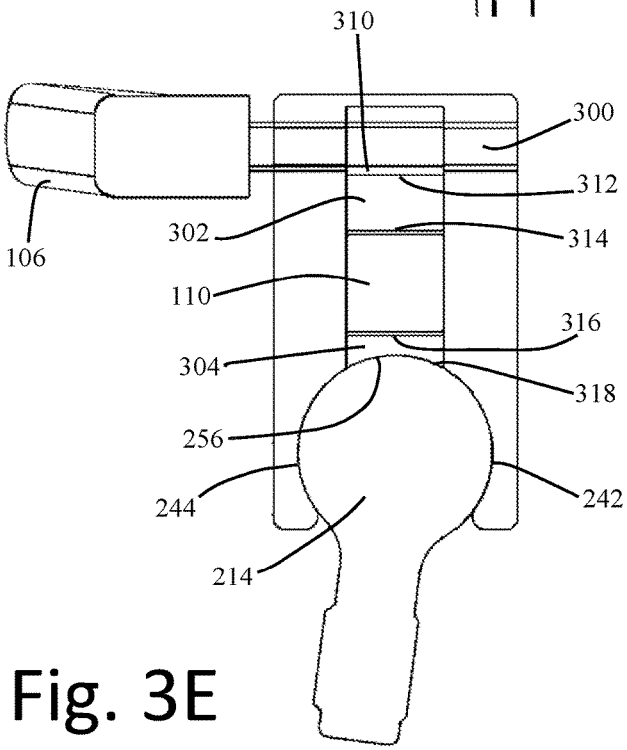
Figure 3F:
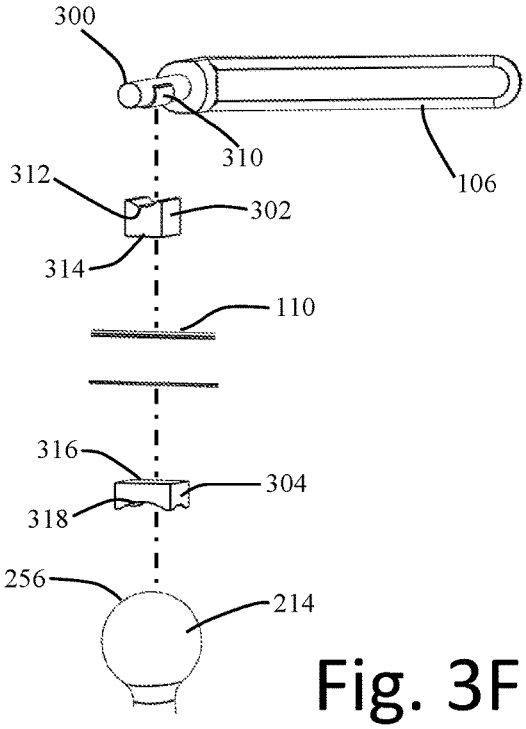

Referring now to FIG. 3F, an exploded perspective view with housing portions 318 and 320 removed is illustrated. Cam shaft 300 includes a portion 310 that extends or projects outward to act as a camming surface. First shoe 302 includes surfaces 312 and 314. In one embodiment, surface 312 is curved and configured to contact camming surface 310. The curvature thereof can be constant or varying. Surface 314 is shown as being substantially flat, but may also be curved, and is configured to contact extension tube 110. Second shoe 304 includes surfaces 316 and 318. In one embodiment, surface 316 is substantially flat, but that may be curved in other embodiments, and is configured to contact extension tube 110. Surface 318 is curved and configured to contact a portion 256 of ball 214.

FIG. 3E illustrates a cross-sectional view taken along section lines 3E-3E of FIG. 3B. As handle/lever 106 is rotated, camming surface 310 contacts surface 312 of first shoe 302. The camming action causes shoe 302 and its surface 314 to bear or press against extension tube 110. Extension tube 110 then begins to bear or press against surface 316 of second shoe 304. This causes second shoe 304 and surface 318 to bear or press against portion 256 of ball 214. This causes ball 214 to bear or press against socket portions 242/244. These actions create a clamping force that locks extension tube 110 and ball 214 from movement. Extension tube is clamped or locked between first and second shoes 302 and 304 and ball 214 is clamped or locked between second shoe 304 and housing socket 212 (or portions 242/244). Unclamping or unlocking is accomplished by rotating the handle/lever 106 in the opposite direction thereby releasing the force or pressure bearing against the shoes 400 and 404, extension tube 110 and ball 214.

Figure 4A:
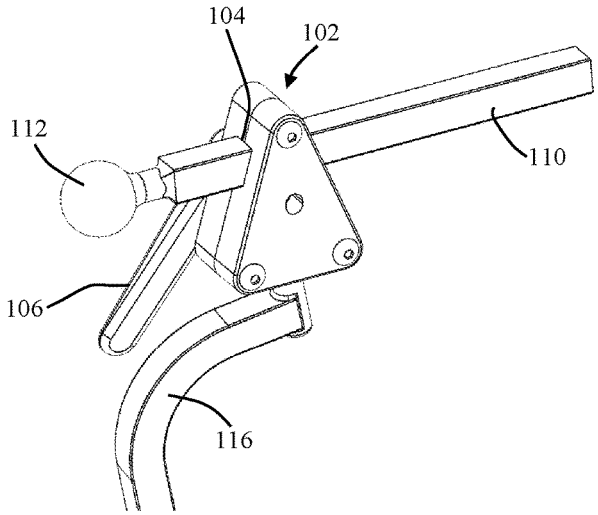
FIGS. 4A-4F illustrates another embodiment of a multi-axis adjustable headrest system and method having wedge and shoe-type locking mechanism or means.
Figure 4B:
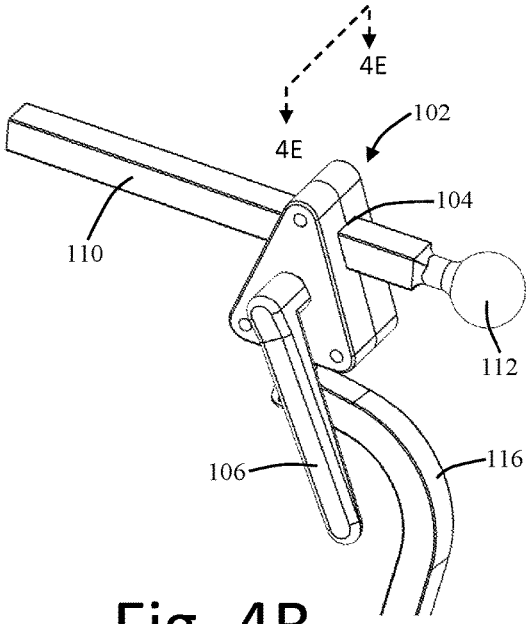
Figure 4C:
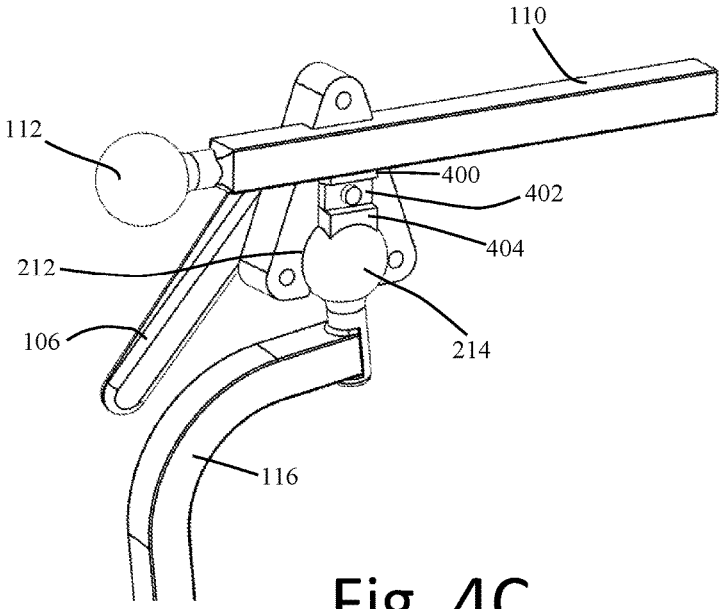

FIGS. 4A-4F illustrate another embodiment of a multi-axis adjustable headrest system and method. This embodiment includes another example of a wedge-type locking mechanism or means. FIGS. 4A-4B illustrate various perspective views of the adjustable headrest system. Referring now to FIG. 4C, where a portion of housing 102 has been removed, the locking mechanism or means includes a wedge driver 402 that is connected to handle/lever 106, a first or extension tube shoe 402 and a second or ball shoe 404. Wedge driver 402 is positioned to contact shoes 400 and 404. Extension tube 110 is positioned between shoe 400 and housing 102. Ball 214 is positioned between shoe 404 and housing 102.

Figure 4D:
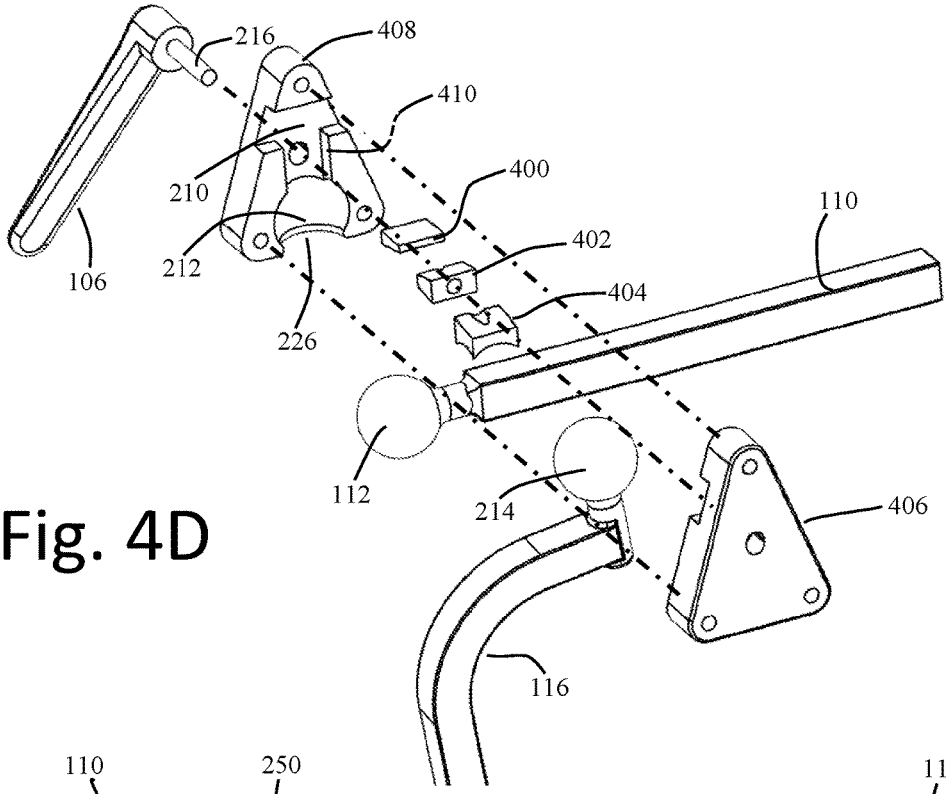

FIG. 4D illustrates an exploded perspective view of the multi-axis headrest system. Housing 102 includes first and second portions 406 and 408, which are fastened together similar to housing portions 206 and 208 of FIGS. 2A-2M. A retaining channel/passage 410 is provided in the housing for wedge driver 402, and shoes 400 and 404. Retaining channel/passage 410 allows movement of shoes 400 and 404 in one direction (e.g., vertical) while restricting or not allowing movement in other directions (e.g., horizontal). Retaining channel/passage 410 allows wedge driver 402 to move in the horizontal direction so its wedging action can cause shoes 400 and 404 to move vertically.

Figure 4E:
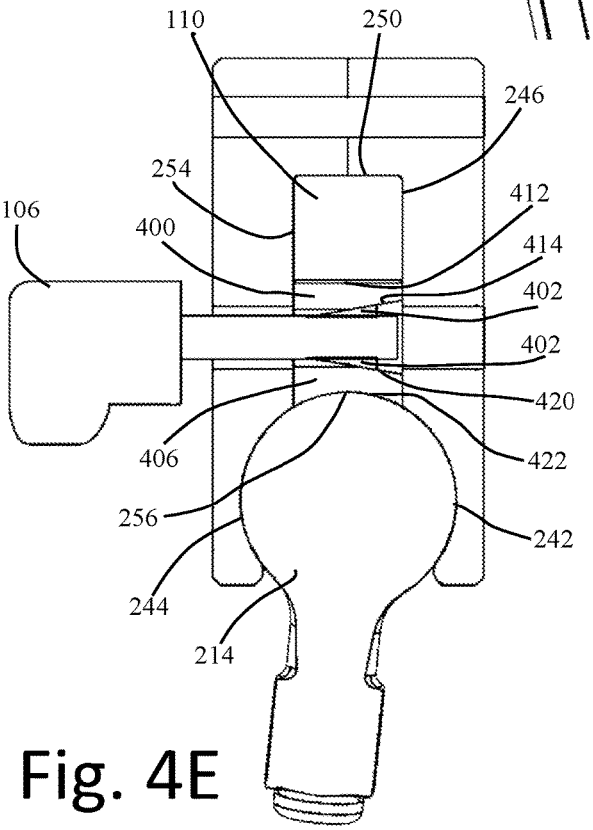
Figure 4F:
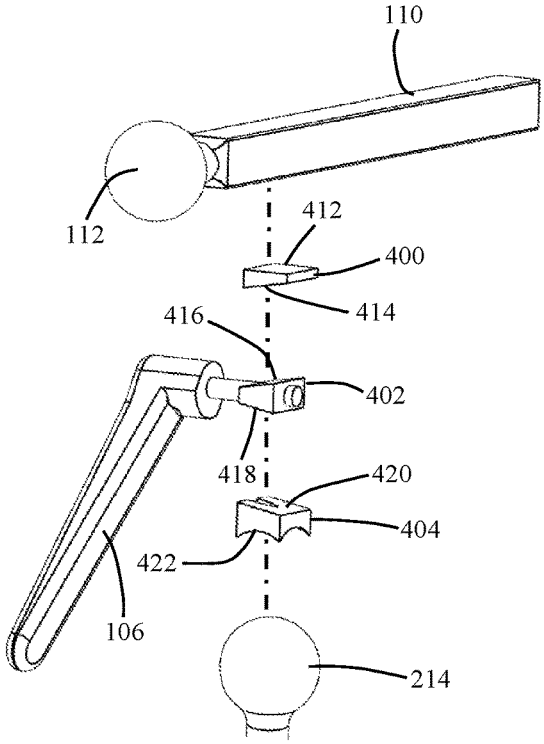

Referring now to FIG. 4F, an exploded perspective view with housing portions 406 and 408 removed is illustrated. Wedge driver 402 has angled surfaces 416 and 418 that cause wedge driver 402 to be smaller at one end and larger at another (thus providing its "wedge"-type shape) and the wedging action. First shoe 400 includes surfaces 412 and 414. In one embodiment, surface 414 is angled and configured to contact surface 416 of wedge driver 402. Surface 412 is shown as being substantially flat, but may also be curved, and is configured to contact extension tube 110. The configuration of surfaces provides shoe 400 with one end that is smaller than the other and assists in the allowing the wedging action to create vertical movement of shoe 400. Second shoe 404 includes surfaces 420 and 422. Surface 420 is angled and configured to contact surface 418 of wedge driver 402. This configuration of surfaces provides shoe 402 with one end that is smaller than the other and assists in the allowing the wedging action to create vertical movement of shoe 404. Surface 422 is curved and configured to contact a portion 256 of ball 214.

FIG. 4E illustrates a cross-sectional view taken along section lines 4E-4E of FIG. 4B. As handle/lever 106 is rotated, wedge driver 402 moves horizontally and begins to drive shoes 400 and 404 apart. The wedging action causes shoe 400 and its surface 412 to bear or press against extension tube 110. Extension tube 110 then begins to bear or press against the upper wall(s) 250 channel housing channel 210. The wedging action also causes shoe 404 and surface 422 to bear or press against portion 256 of ball 214. This causes ball 214 to bear or press against housing socket portions 242/244. These actions create a clamping force that locks extension tube 110 and ball 214 from movement. Extension tube is clamped or locked between first shoe 400 and housing channel 210 and ball 214 is clamped or locked between second shoe 404 and housing socket 212 (or portions 242/244). Unclamping or unlocking is accomplished by rotating the handle/lever 106 in the opposite direction thereby releasing the force or pressure bearing against the shoes 400 and 404, extension tube 110 and ball 214.

Figure 5A:
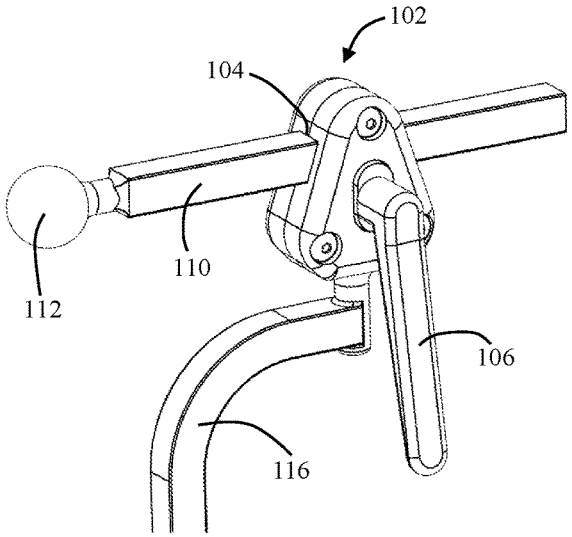
FIGS. 5A-5F illustrates another embodiment of a multi-axis adjustable headrest system and method having wedge-type locking mechanism or means.
Figure 5B:
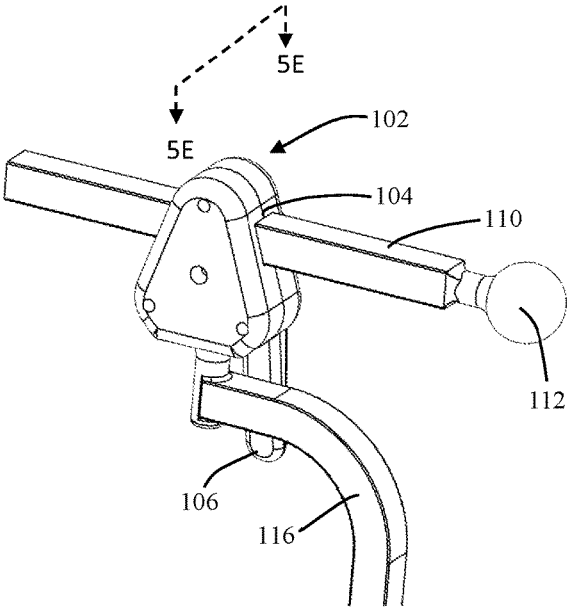
Figure 5C:
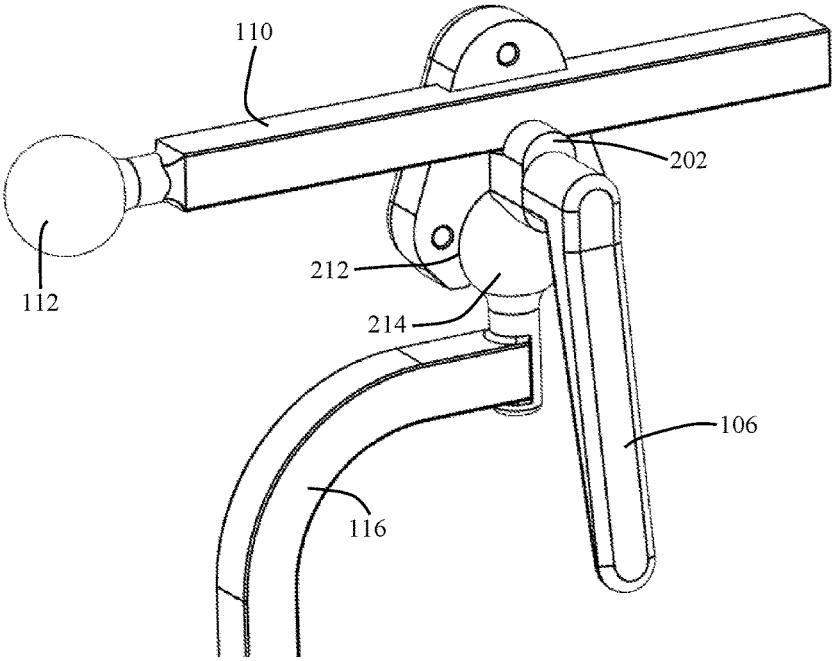

FIGS. 5A-5F illustrate another embodiment of a multi-axis adjustable headrest system and method. This embodiment includes another example of a wedge-type locking mechanism or means. FIGS. 5A-5B illustrate various perspective views of the adjustable headrest system. Referring now to FIG. 5C, where a portion of housing 102 has been removed, the locking mechanism or means includes a single wedge 202 that is connected to handle/lever 106. In this embodiment, wedge 202 is identical to wedge 202 shown and described in connection with FIGS. 2A-2M but may vary in other embodiments therefrom in shape, size, and configuration. Wedge driver 202 is positioned to contact both extension tube 110 and ball 214. Extension tube 110 is positioned between wedge 202 and housing 102. Ball 214 is also positioned between wedge 202 and housing 102. Whereas in the embodiment of FIGS. 2A-2M, a second wedge 204 was included, this embodiment uses only a single wedge 202.

Figure 5D:
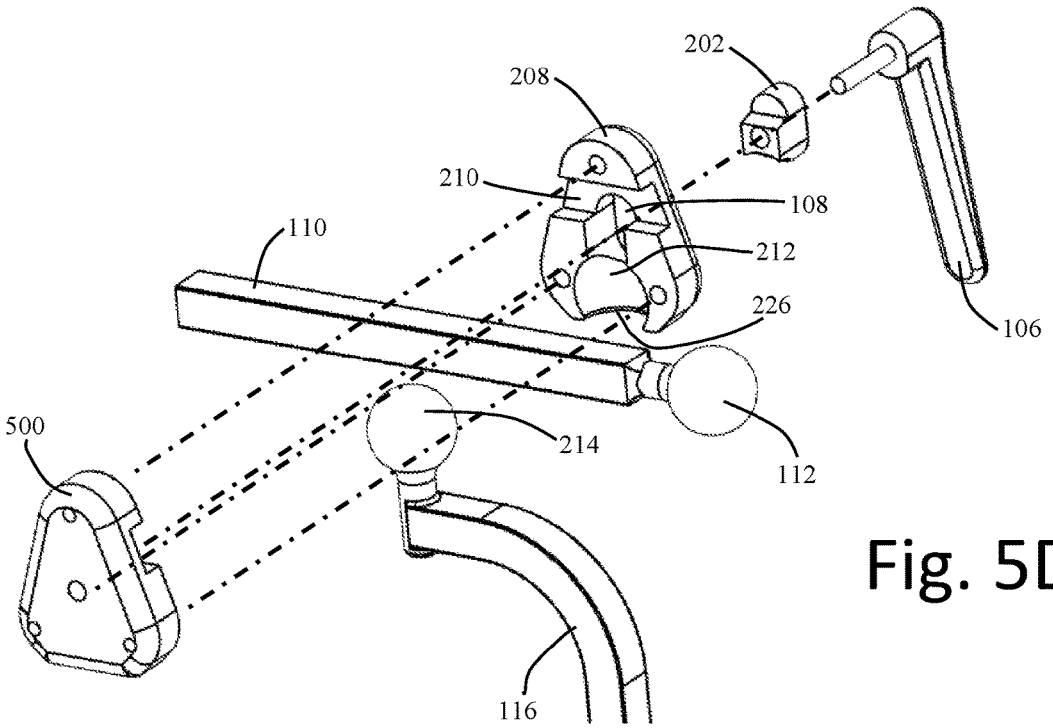

FIG. 5D illustrates an exploded perspective view of the multi-axis headrest system. Housing 102 includes first and second portions 208 and 500, which are fastened together similar to housing portions 206 and 208 of FIGS. 2A-2M. Housing portion 500 is similar to housing portion 206 of FIGS. 2A-2M, but additionally includes wall/surface 502 as part of channel 210. This wall/surface 502 at least partially retains and supports extension tube 110 within channel 210 when no clamping force is applied. In alternative embodiments, wall/surface 502 can be eliminated. Opening 108 is provided in the housing for wedge 202 allowing horizontal movement of wedge 202 while restricting or not allowing movement in other directions (e.g., vertical). Movement in the horizontal direction allows wedge 202 to create a wedging action causes wedge 202 to contact extension tube 110 and ball 214 to clamp (lock) and unclamp (unlock) them from movement.

Figure 5E:
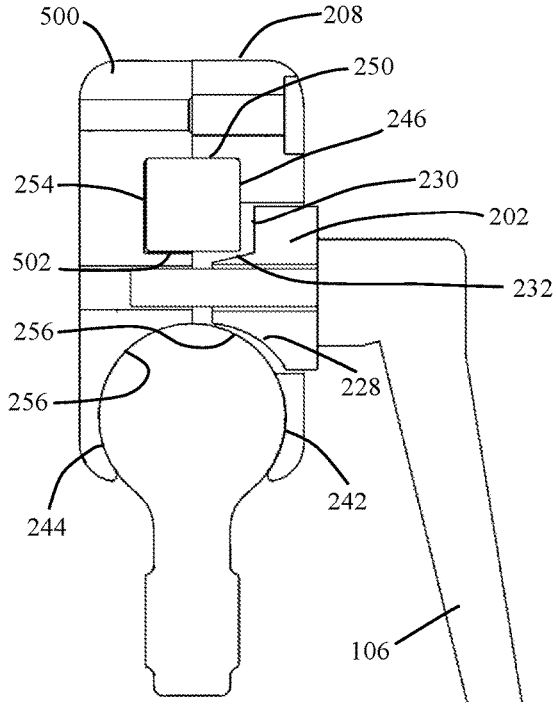
Figure 5F:
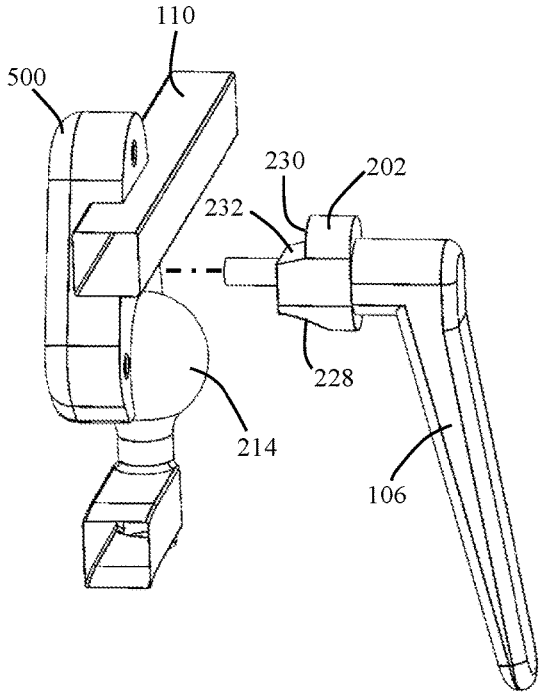

Referring now to FIG. 5F, a partial exploded perspective view with housing portions 208 removed is illustrated. Wedge 202 has vertical wall/surface 230 and angled wall/surfaces 232 that cause wedge 202 to be smaller at one end and larger at another (thus providing its "wedge"-type shape or portion) and the wedging action against extension tube 110. Wedge 202 also includes curved wall/surface 228 for contacting ball 214.

FIG. 5E illustrates a cross-sectional view taken along section lines 5E-5E of FIG. 5B. As handle/lever 106 is rotated, wedge 202 moves horizontally and begins to drive shoes 400 and 404 apart. In the present embodiment, wedge 202 generates clamping forces to securely hold extension tube 110 and ball 214. For extension tube 110, one portion of the clamping action/force is generated by angled wedge surface 232. Turning of handle/lever 106 causes wedge 202 to increasingly bear or press against the lower portion of extension tube 110 (which can include the lower corner portions, lower side wall portions, bottom wall portion, and other lower portions of extension tube 110). As the angled wedge surface 232 presses against the lower portion of extension tube 110, this causes at least the upper (and may additionally cause the side portion) of extension tube 110 to bear or press against one or more of housing channel/passageway 210 walls or surfaces 246, 248, 250, 252, and/or 254 (see also FIG. 2M) thereby providing another portion of the clamping action/force. In one embodiment, extension tube 110 bears or presses against at least wall or surface 250. As previously mentioned, these walls or surfaces (e.g., 246-254) are substantially rigid and able to withstand significantly high (clamping) forces to allow secure holding/locking of extension tube 110 in position.

Wedges 202 also generates clamping forces to securely hold ball 214. One portion of the clamping action/force is generated by curved wedge surface 228 as it moves to through turning of handle/lever 106 to increasingly bear or press against the upper and/or side portions 256 of ball 214. As curved wedge surface 228 bears or presses against the top and/or sides 256, ball 214 is forced downwards to increasing bear or press against contact socket contact surfaces 242 and 244 (which may also be a single circumferential surface that is part of socket 212) thereby providing another portion of the clamping action/force against ball 214. Here too, these socket walls or surfaces (e.g., 242 and 244) are substantially rigid and able to withstand significantly high (clamping) forces to allow secure holding/locking of ball 214 in position. Hence, when handle/lever 106 is turned in a first direction (e.g., clockwise), wedges 202 and 204 generate a clamping action/force that locks both extension tube 110 and ball 214 against housing 102. Unclamping or unlocking is accomplished by rotating the handle/lever 106 in the opposite direction thereby releasing the force or pressure bearing against extension tube 110 and ball 214.

Figure 6A:
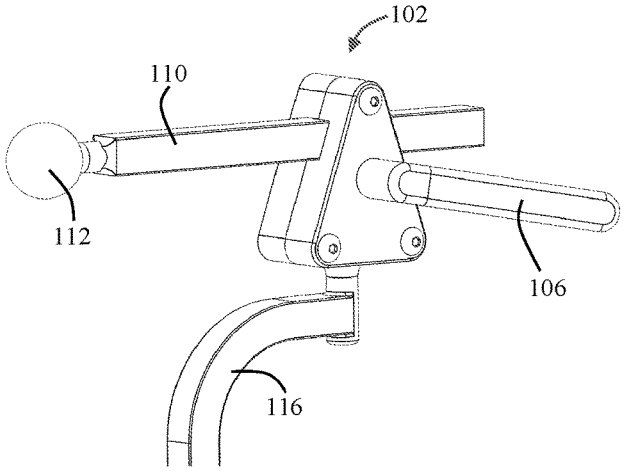
FIGS. 6A-6J illustrates another embodiment of a multi-axis adjustable headrest system and method having cam-type locking mechanism or means.
Figure 6B:
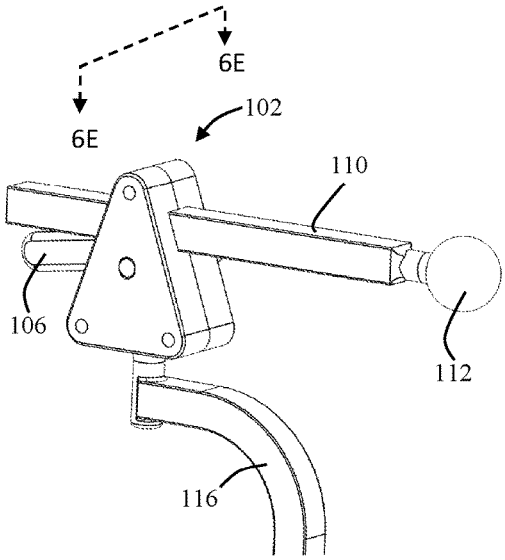
Figure 6C:
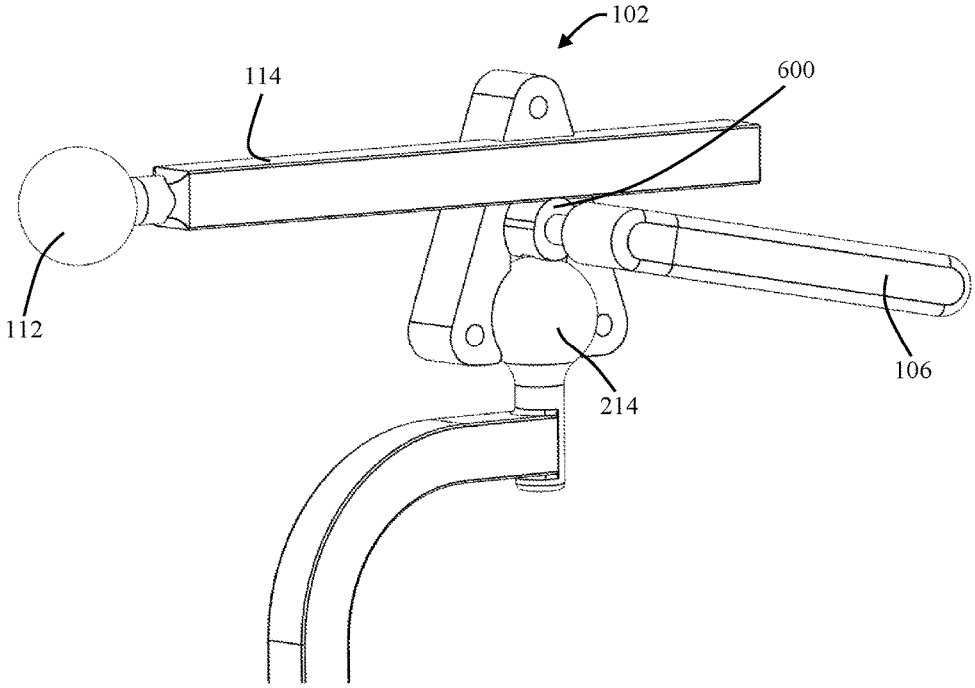

FIGS. 6A-6J illustrate another embodiment of a multi-axis adjustable headrest system and method. This embodiment includes an example of a cam wedge-type locking mechanism or means. FIGS. 6A-6B illustrate various perspective views of the adjustable headrest system. Referring now to FIG. 6C, where a portion of housing 102 has been removed, the locking mechanism or means includes a cam wedge 600 that is connected to handle/lever 106. In this embodiment, cam wedge 600 is positioned to contact both extension tube 110 and ball 214. Extension tube 110 is positioned between cam wedge 600 and housing 102. Ball 214 is also positioned between cam wedge 600 and housing 102.

Figure 6D:
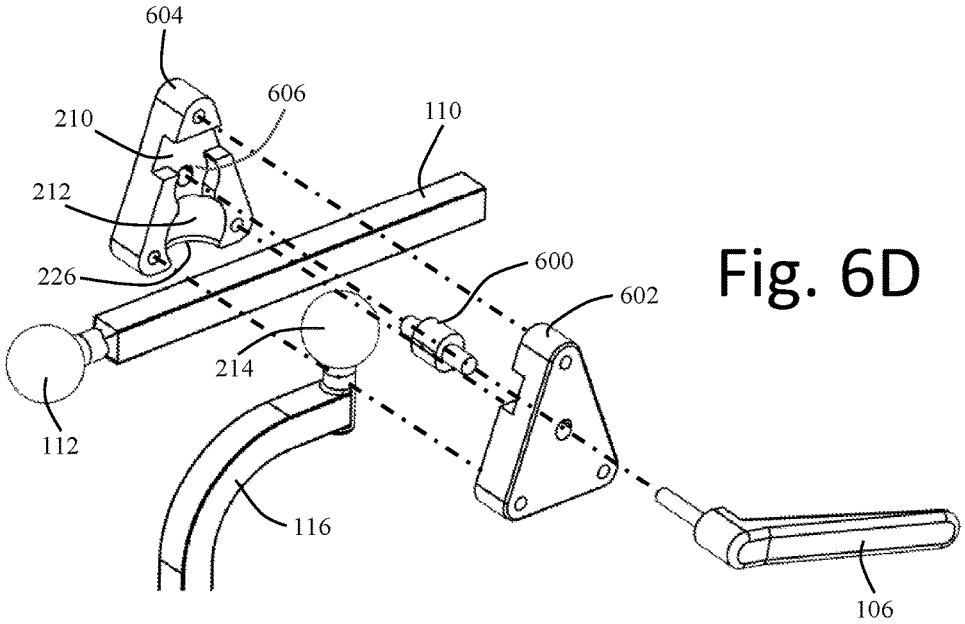

FIG. 6D illustrates an exploded perspective view of the multi-axis headrest system. Housing 102 includes first and second portions 602 and 604, which are fastened together similar to housing portions 206 and 208 of FIGS. 2A-2M. A retaining space 606 is provided for housing cam wedge 600. Retaining space 606 allows cam wedge 600 to rotate so that it can contact extension tube 110 and ball 214 to clamp and unclamp these components.

Figure 6E:
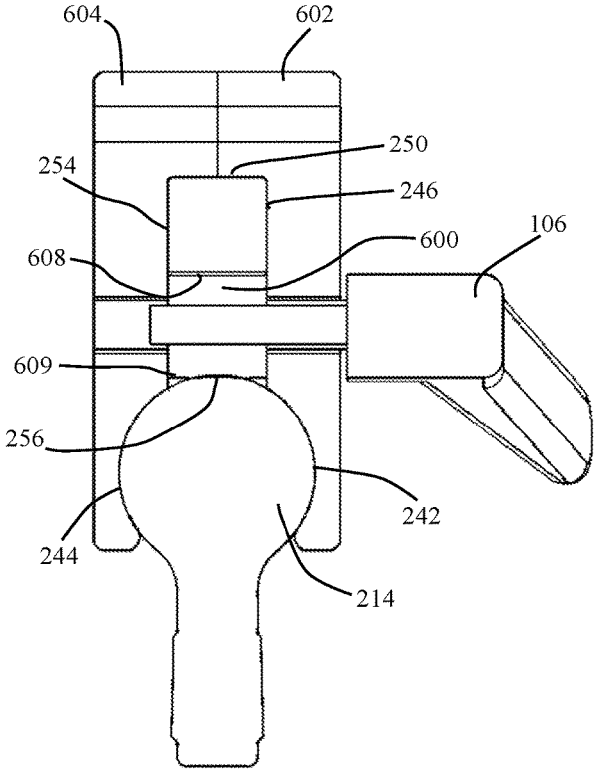
Figure 6F:
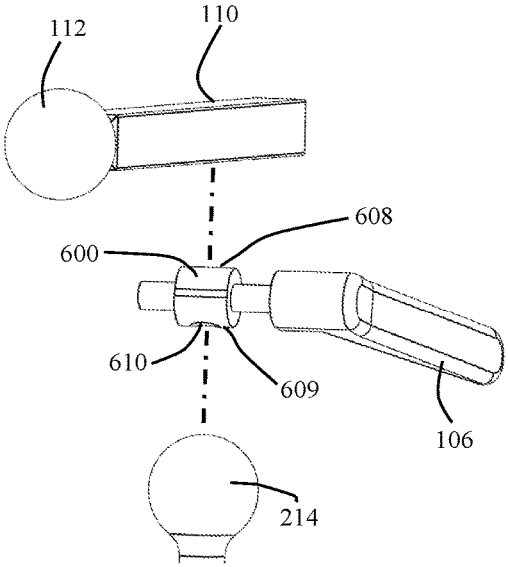
Figure 6G:
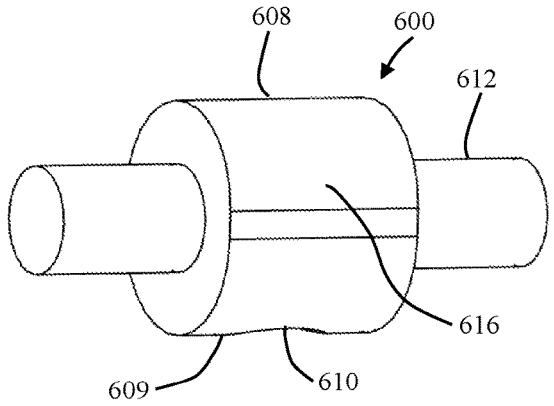
Figure 6H:
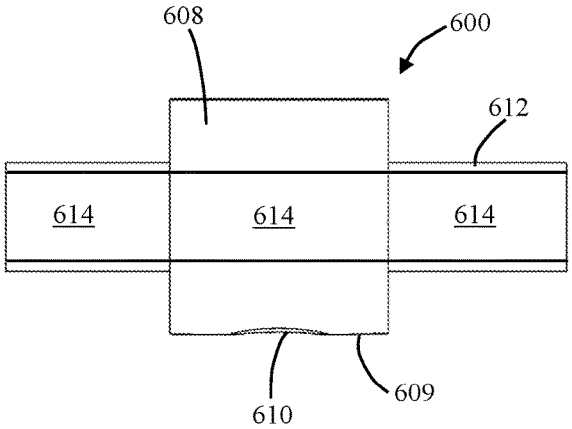
Figure 6I:
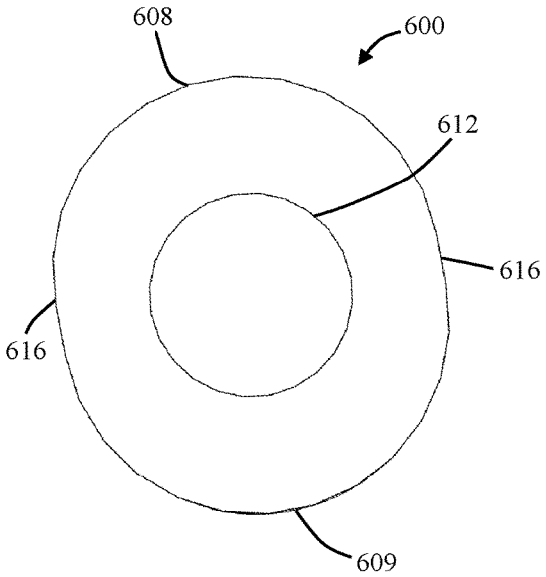

Referring now to FIG. 6F, a partial exploded perspective view with housing portions 602 and 604 removed is illustrated. Cam wedge 600 has a first cam surface 608 and a second cam surface 609. Each cam surface has a non-constant curvature that allows to provide a camming action as it is moved (or rotated) against another surface. The cam surfaces 608 and 609 can be identical or different in size and shape. For example, cam surface 609 can include a recessed portion 610 for receiving and contacting surface portion 256 of ball 214. Recessed portion 610 can be curved, stepped or otherwise indented.

FIG. 6E illustrates a cross-sectional view taken along section lines 6E-6E of FIG. 6B. As handle/lever 106 is rotated, cam wedge 600 rotates cam surfaces and contact extension tube 110 and ball 214. The cam surfaces 608 and 609 are configured to increase the distances between them as they are rotated. In this manner, cam wedge 600 and cam surface 608 to bear or press against the bottom portion of extension tube 110. This causes extension tube 110 to bear or press against the upper portion of housing channel 210 (e.g., surface 250). Thus, a clamping action/force is generated on extension tube 110 by cam wedge 600 and housing 102 to lock extension tube 210 from movement. Rotation of handle/lever 106 also causes cam wedge 600 and cam surface 609 to bear or press against surface portion 256 of ball 214. This causes ball 214 to bear or press against housing socket surface(s) 242/244. Hence, a clamping action/force is generated on ball 214 by cam wedge 600 and housing 102 to lock ball 214 from movement. As previously discussed, the walls or surfaces of housing 102 are substantially rigid and able to withstand significantly high (clamping) forces to allow secure holding/locking of extension tube 110 and ball 214 in position. Unclamping or unlocking is accomplished by rotating the handle/lever 106 in the opposite direction thereby releasing the force or pressure bearing against extension tube 110 and ball 214.

Figure 6J:
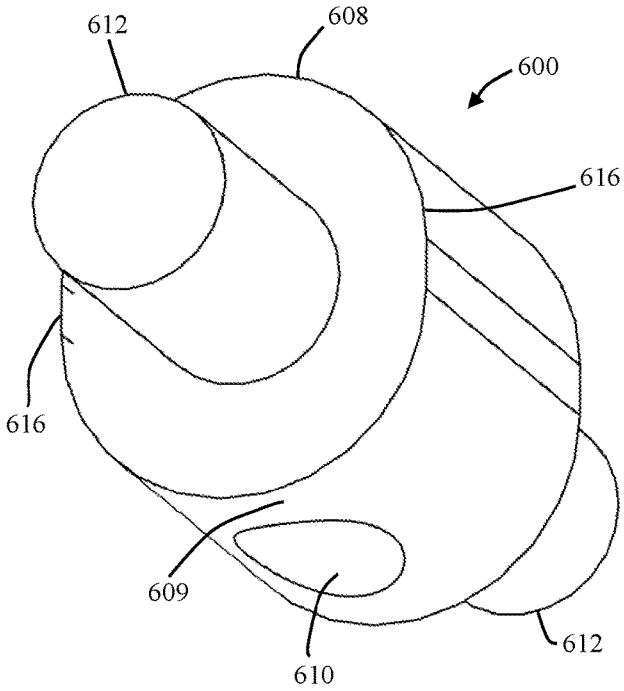

FIGS. 6G-6J show various views of cam wedge 600. Cam wedge 600 includes a mounting extension 612 for connecting to handle/lever 106. Internal space 614 of mounting extension 612 can be threaded, keyed, slotted or otherwise configured to receive and securely connect cam wedge 600 to handle/lever 106. FIG. 6J shows a side elevational view of cam wedge 600 and the configuration of cam surfaces 608 and 609. In this embodiment, relatively flattened portions 616 having very little (or even no) curvature reside between cam surfaces 608 and 609. Portions 616 provide cam surfaces 608 and 609 with a non-constant curvature (or an offset curvature) that provides for camming action as cam wedge 600 is rotated. The distance between portions 616 is smaller than the peak distance between cam surfaces 608 and 609 thereby also providing them with their camming characteristic as they are rotated against extension tube 110 and ball 214.

Figure 7A:
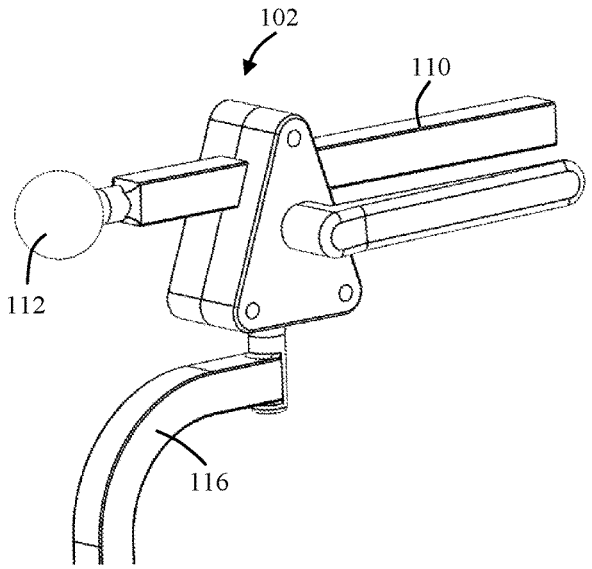
FIGS. 7A-7F illustrates another embodiment of a multi-axis adjustable headrest system and method having cam and shoe-type locking mechanism or means.
Figure 7B:
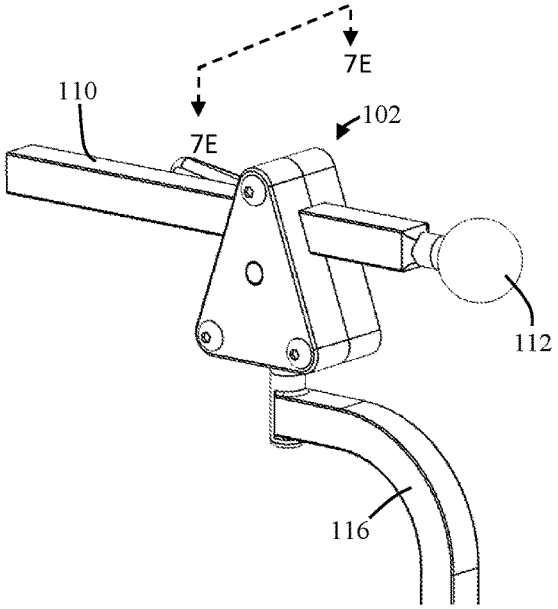
Figure 7C:
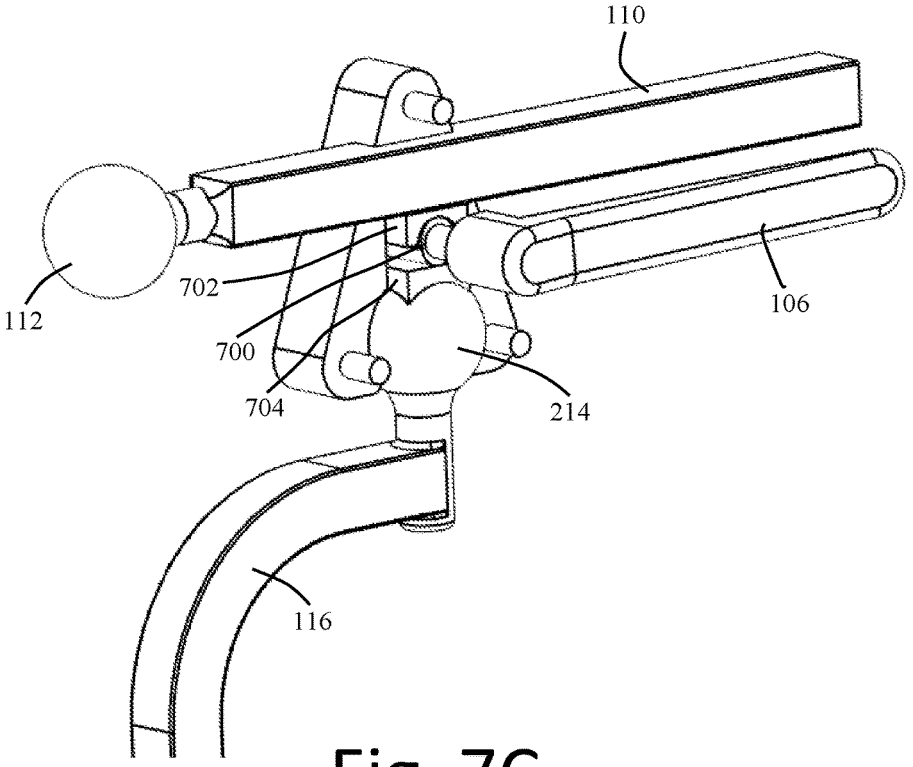

FIGS. 7A-7F illustrate another embodiment of a multi-axis adjustable headrest system and method. This embodiment includes another example of a cam and shoe-type locking mechanism or means. FIGS. 7A-7B illustrate various perspective views of the adjustable headrest system. Referring now to FIG. 7C, where a portion of housing 102 has been removed, the locking mechanism or means includes a cam shaft/driver 700 that is connected to handle/lever 106, a first or extension tube shoe 702 and a second or ball shoe 704. Cam shaft 300 is positioned to contact shoes 702 and 704. Extension tube 110 is positioned between shoe 702 and housing 102. Ball 214 is positioned between shoe 704 and housing 102.

Figure 7D:
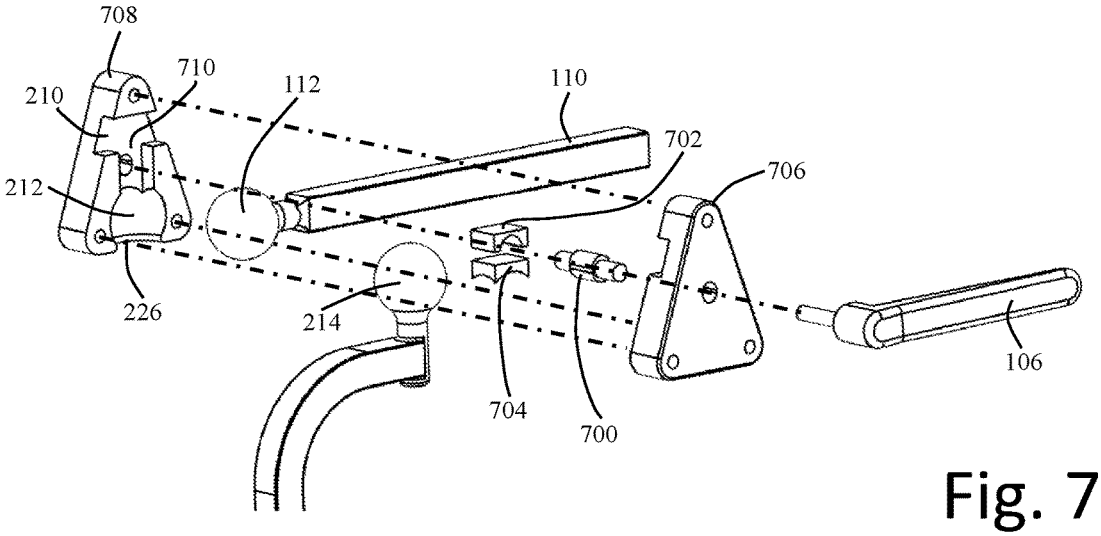

FIG. 7D illustrates an exploded perspective view of the multi-axis headrest system. Housing 102 includes first and second portions 706 and 708, which are fastened together similar to housing portions 206 and 208 of FIGS. 2A-2M. A retaining channel/passage 710 is provided in the housing for cam shaft/driver 700, and shoes 702 and 704. Retaining channel/passage 710 allows movement of shoes 302 and 304 in one direction (e.g., vertical) while restricting or not allowing movement in other directions (e.g., horizontal).

Figure 7E:
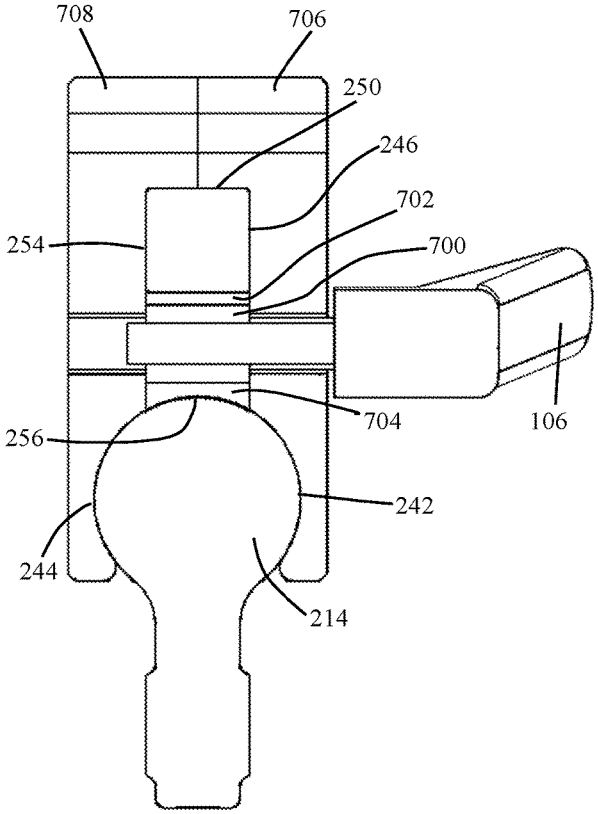
Figure 7F:
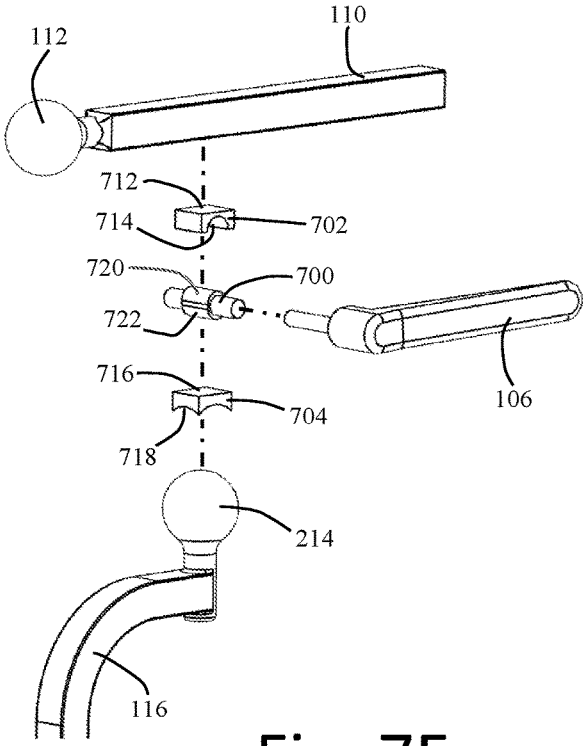

Referring now to FIG. 7F, an exploded perspective view with housing portions 706 and 708 removed is illustrated. Cam shaft/driver 700 has a portions/surfaces 720 and 722 that extend or project outward to act as camming surfaces. First shoe 702 includes surfaces 712 and 714. In one embodiment, surface 714 is curved and configured to contact camming surface 720. The curvature thereof can be constant or varying. Surface 712 is shown as being substantially flat, but may also be curved, and is configured to contact extension tube 110. Second shoe 704 includes surfaces 716 and 718. In one embodiment, surface 716 is substantially flat, but that may be curved in other embodiments, and is configured to contact extension tube 110. Surface 318 is curved and configured to contact a portion 256 of ball 214.

FIG. 7E illustrates a cross-sectional view taken along section lines 7E-7E of FIG. 7B. As handle/lever 106 is rotated, camming surfaces 720 contacts surface 714 of first shoe 702 and camming surface 722 contacts surface 716 of second shoe 704. The camming action causes shoe 702 and its surface 712 to bear or press against extension tube 110. Extension tube 110 then begins to bear or press against the upper wall(s) 250 channel housing channel 210. The camming action also causes shoe 704 and surface 718 to bear or press against portion 256 of ball 214. This causes ball 214 to bear or press against housing socket portions 242/244. These actions create a clamping force that locks extension tube 110 and ball 214 from movement. Extension tube is clamped or locked between first shoe 702 and housing channel 210 and ball 214 is clamped or locked between second shoe 304 and housing socket 212 (or portions 242/244). Unclamping or unlocking is accomplished by rotating the handle/lever 106 in the opposite direction thereby releasing the force or pressure bearing against the shoes 702 and 704, extension tube 110 and ball 214.

Figure 8:
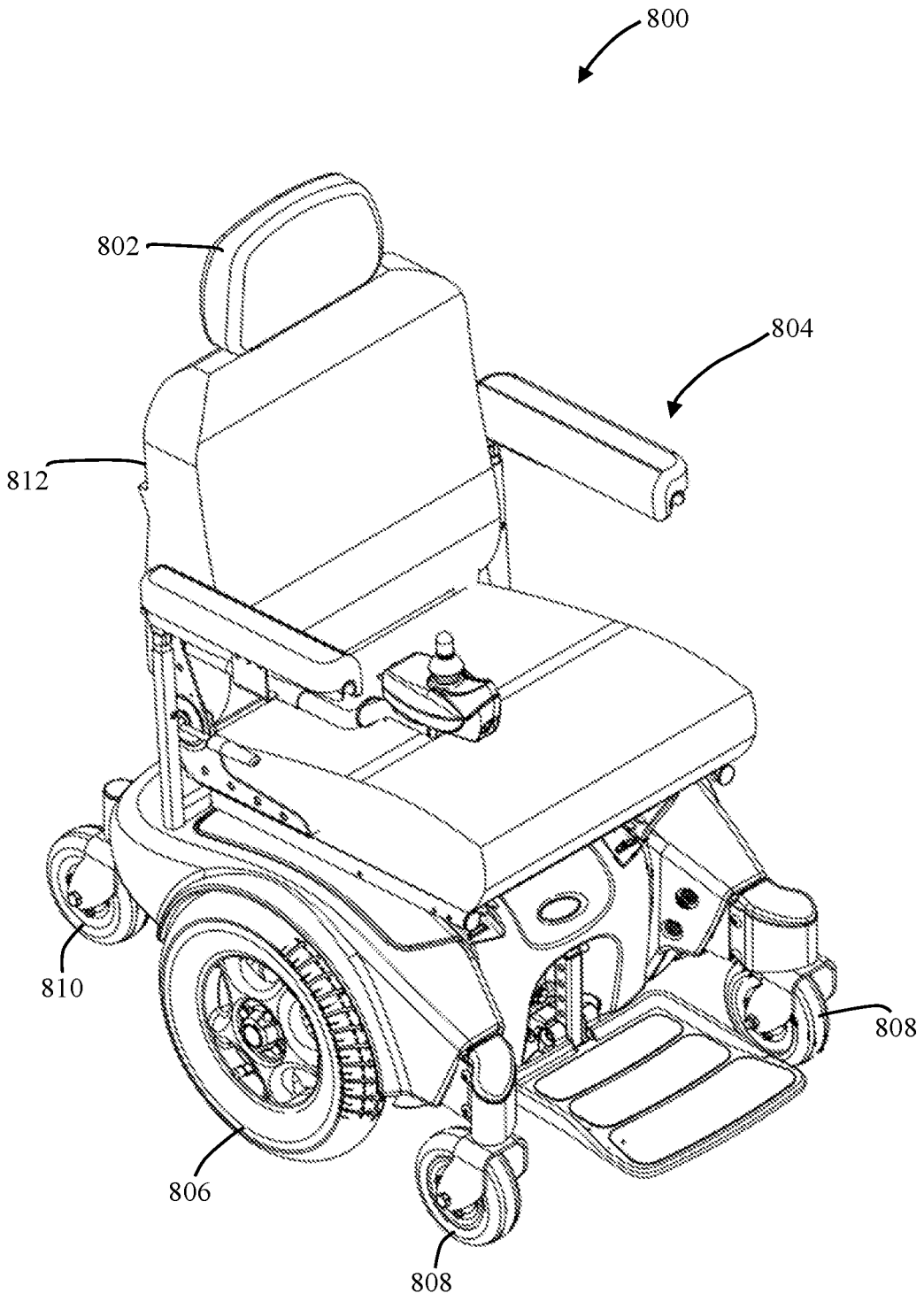
FIG. 8 illustrates one embodiment of a wheelchair having a multi-axis adjustable headrest system and method.

FIG. 8 illustrates one embodiment of a power wheelchair 800 having the adjustable multi-axis headrest system. Wheelchair 800 includes a seating system 804 having a seat and a seat back 812. The adjustable multi-axis headrest system disclosed herein can be mounted to the reverse side of seat back 812 using fasteners and/or clamps. The adjustable multi-axis headrest system disclosed herein allows headrest pad 802 to be adjusted in four dimensions: yaw angle, pitch angle, roll angle, and extension/retraction (e.g., see FIG. 1) to optimize the comfort, function and safety of the user.

While the present inventions have been illustrated by the description of embodiments thereof, and while the embodiments have been described in considerable detail, it is not the intention of the descriptions to restrict or in any way limit the scope of the inventions to such detail. Additional advantages and modifications will readily appear to those skilled in the art. Therefore, the inventions, in their broader aspects, are not limited to the specific details, the representative apparatus, and illustrative examples shown and described. Accordingly, departures can be made from such details without departing from the spirit or scope of the general inventive concepts.

What is claimed:

1. Headrest system comprising:

a headrest mounting assembly;

a headrest extension tube;

housing receiving at least a portion of the headrest mounting assembly and extension tube therein;

a lever connected to the housing;

a locking mechanism responsive to movement of the lever; wherein the locking mechanism comprises a first surface portion contacting the head rest extension tube and a second surface portion contacting the head rest mounting assembly;

wherein the headrest mounting assembly comprises a ball end that is at least partially received in the housing and contacted by the second surface portion.

2. The system of claim 1 wherein the locking mechanism further comprises a body having the first and second surface portions, the first surface portion contacting the headrest extension tube and the second surface portion contacting the headrest mounting assembly and the housing comprises a retaining space for receiving the locking mechanism body and allowing movement of the body relative to the headrest extension tube and headrest mounting assembly.

3. The system of claim 2 wherein the first surface portion contacting the headrest extension tube comprises first and second contact surfaces having an angle of greater than 90 degrees therebetween.

4. The system of claim 3 wherein the second surface portion contacting the headrest mounting assembly comprises a curved surface.

5. The system of claim 1 wherein the locking mechanism further comprises first and second bodies received in a retaining space of the housing that allows movement of the first and second bodies to each contact the headrest extension tube and the headrest mounting assembly.

6. The system of claim 1 wherein the locking mechanism further comprising a body having the first and second surface portions, the first portion contacting the headrest extension tube and the second surface portion contacting the headrest mounting assembly and the housing comprises a retaining space for receiving the locking mechanism body and allowing movement of the body relative to the headrest extension tube and head rest mounting assembly; and wherein movement of the body within the retaining space causes the headrest extension tube and headrest mounting assembly to press against the housing to prevent movement of the headrest extension tube and headrest mounting assembly relative to the housing.

7. The system of claim 1 wherein the headrest extension tube is received within the housing by a channel space and the headrest mounting assembly is received within the housing by a socket space and the locking mechanism further comprises a body having the first and second surface portions, the first surface portion contacting the headrest extension tube and the second surface portion contacting the headrest mounting assembly; wherein the body of the locking mechanism is received within a retaining space disposed between the channel space and the socket space.

8. The system of claim 1 wherein the housing comprises first and second portions that are rigidly affixed to each other.

9. The system of claim 1 wherein the locking mechanism further comprises a wedge body having the first and second surface portions, the first surface portion contacting the headrest extension tube and the second surface portion contacting the headrest mounting assembly and the housing comprises a retaining space for receiving the locking mechanism wedge body and allowing movement of the wedge body relative to the headrest extension tube and headrest mounting assembly.

10. Headrest system comprising:

a headrest mounting assembly;

a headrest extension tube;

housing receiving at least a portion of the headrest mounting assembly and extension tube therein;

a lever connected to the housing;

a locking means responsive to movement of the lever; wherein the locking means comprises a first surface means contacting the head rest extension tube and a second surface means contacting head rest mounting assembly; and wherein the headrest mounting assembly comprises a ball end that is at least partially received in the housing and contacted by the second surface means.

11. The system of claim 10 wherein the locking means further comprises a body having the first and second surface means, the first surface means contacting the headrest extension tube and the second surface means contacting the headrest mounting assembly and the housing comprises a retaining space for receiving the locking means body and allowing movement of the body relative to the headrest extension tube and headrest mounting assembly.

12. The system of claim 11 wherein the first surface means contacting the headrest extension tube comprises first and second contact surfaces having an angle of greater than 90 degrees therebetween.

13. The system of claim 12 wherein the second surface means contacting the headrest mounting assembly comprises a curved surface.

14. The system of claim 10 wherein the locking means further comprises first and second bodies received in a retaining space of the housing that allows movement of the first and second bodies to each contact the headrest extension tube and the headrest mounting assembly.

15. Headrest system comprising:

a headrest mounting means;

a headrest extension means;

housing means receiving at least a portion of the headrest mounting means and extension tube means;

a hand actuating means connected to the housing;

a locking means responsive to movement of the hand actuating means; wherein the locking means comprises a first surface means contacting the head rest extension means and a second surface means contacting head rest mounting means; and wherein the headrest mounting means comprises a ball means that is at least partially received in the housing means and contacted by the second surface means.

16. The system of claim 15 wherein the locking means further comprises a body having the first and second surface means, the first surface means contacting the headrest extension means and the second surface means contacting the headrest mounting means and the housing comprises a retaining space for receiving the locking means body and allowing movement of the body relative to the headrest extension means and headrest mounting means.

17. The system of claim 16 wherein the first surface means contacting the headrest extension means comprises first and second contact surfaces having an angle of greater than 90 degrees therebetween.

18. The system of claim 17 wherein the second surface means contacting the headrest mounting means comprises a curved surface.

* * * * *